US012344988B2

(12) United States Patent
Choi et al.

(10) Patent No.: US 12,344,988 B2
(45) Date of Patent: Jul. 1, 2025

(54) LAUNDRY TREATMENT APPARATUS

(71) Applicant: LG ELECTRONICS INC., Seoul (KR)

(72) Inventors: Kyoungmin Choi, Seoul (KR); Kwanwoong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 918 days.

(21) Appl. No.: 17/511,684

(22) Filed: Oct. 27, 2021

(65) Prior Publication Data

US 2022/0049412 A1 Feb. 17, 2022

Related U.S. Application Data

(63) Continuation of application No. 16/428,421, filed on May 31, 2019, now Pat. No. 11,186,942.

(30) Foreign Application Priority Data

Jun. 1, 2018 (KR) ..... 10-2018-0063395
Jun. 1, 2018 (KR) ..... 10-2018-0063396
Jun. 1, 2018 (KR) ..... 10-2018-0063397

(51) Int. Cl.
*D06F 58/10* (2006.01)
*D06F 58/26* (2006.01)

(52) U.S. Cl.
CPC ..... *D06F 58/10* (2013.01); *D06F 58/26* (2013.01)

(58) Field of Classification Search
CPC ..... D06F 58/10; D06F 58/26
See application file for complete search history.

(56) References Cited

U.S. PATENT DOCUMENTS 577,758 A * 2/1897 Keyser et al. ..... F25D 25/02 160/403
701,481 A * 6/1902 Hart ..... F24F 13/08 105/457

(Continued)

FOREIGN PATENT DOCUMENTS

CN 2594292 Y 12/2003
CN 2700375 5/2005

(Continued)

OTHER PUBLICATIONS

China Office Action in China Application No. 201910474876.2, dated Jan. 6, 2021 and English Translation thereof (17 pages).

(Continued)

*Primary Examiner* — Edelmira Bosques
*Assistant Examiner* — Bao D Nguyen
(74) *Attorney, Agent, or Firm* — Birch, Stewart, Kolasch & Birch, LLP

(57) ABSTRACT

The present disclosure relates to a laundry treatment apparatus including a cabinet having an entrance, a drawer comprising a drying chamber, a bottom surface, a front surface extending upward from the bottom surface, a rear surface to face the front surface, and first and second side surfaces to connect the front and rear surfaces. The laundry apparatus includes a first rack disposed in the drying chamber, the first rack comprising a first vent portion allowing a space above and below the first rack to communicate with each other, a second rack disposed in the drying chamber and positioned between the first rack and the bottom surface, the second rack comprising a second vent portion, a supply port formed through the rear surface, an air supply unit located outside the drying chamber, and a guide in the supply port to guide air to at least one of the spaces.

17 Claims, 12 Drawing Sheets

(56) References Cited

U.S. PATENT DOCUMENTS 1,022,312 A * 4/1912 Foster et al. ..... E06B 9/522 126/339
1,121,853 A * 12/1914 Martin ..... F26B 25/18 34/238
1,752,797 A * 4/1930 Hutchinson, Jr. ..... F26B 9/06 219/400
1,961,144 A * 6/1934 Griffith ..... F25D 25/02 D25/48.8
2,018,085 A * 10/1935 Otte ..... B21D 31/043 D25/48.8
2,179,256 A * 11/1939 Gill ..... A61L 2/04 219/400
2,359,138 A * 9/1944 Martin ..... D06F 43/085 210/167.01
2,470,646 A * 5/1949 Richardson ..... A47K 10/06 392/382
2,789,877 A * 4/1957 Pfundt ..... A23B 4/052 426/235
2,923,997 A * 2/1960 Emmerling ..... F27D 5/0012 108/180
3,002,444 A * 10/1961 Hoebing ..... A47J 37/0709 126/41 R
3,023,514 A * 3/1962 Gibson ..... D06F 58/10 219/400
3,270,660 A * 9/1966 Filipak ..... F24C 7/06 219/403
3,386,454 A * 6/1968 Kendt ..... A47L 15/4229 68/13 A
3,386,582 A * 6/1968 Brezosky ..... C02F 1/42 68/13 A
3,402,477 A * 9/1968 Hubbard ..... D06F 39/125 34/543
3,955,488 A * 5/1976 Wheeler ..... F26B 9/066 99/467
3,994,034 A * 11/1976 Van Damme ..... A01K 47/06 449/12
4,192,991 A * 3/1980 Peters ..... F24C 3/008 219/403
4,224,743 A * 9/1980 Erickson ..... F26B 21/02 126/21 A
4,307,659 A * 12/1981 Martin ..... A47J 37/06 99/446
4,355,570 A * 10/1982 Martin ..... A47J 37/06 219/393
5,243,961 A * 9/1993 Harris ..... F24B 1/205 29/DIG. 37
D341,459 S * 11/1993 Yang ..... D34/21
5,369,892 A * 12/1994 Dhaemers ..... F26B 21/00 34/224
D377,656 S * 1/1997 Leone ..... D15/147
5,666,743 A * 9/1997 Dawson ..... A47L 23/205 34/202
5,810,179 A * 9/1998 Kleiman ..... A47B 61/00 211/90.03
5,870,836 A * 2/1999 Grimes ..... F26B 9/003 34/202
D411,045 S * 6/1999 Morandi ..... D34/21
6,069,343 A * 5/2000 Kolowich ..... A61M 1/1668 219/521
6,191,391 B1 * 2/2001 Deo ..... F24C 15/18 219/407
D451,675 S * 12/2001 Hardy ..... D3/306
6,330,777 B1 * 12/2001 Padley ..... B21D 47/04 108/51.11
D460,848 S * 7/2002 Tzeng ..... D34/21
7,270,245 B2 * 9/2007 Cheng ..... A47B 55/02 220/62.1
7,913,419 B2 3/2011 Tomasi et al.
8,127,757 B1 * 3/2012 Bourgeois ..... A47J 37/0704 126/30
8,769,997 B2 * 7/2014 Moon ..... D06F 31/00 68/5 R
8,944,261 B1 * 2/2015 Boonpakom ..... A23B 4/031 211/126.15
9,131,773 B2 * 9/2015 Tsai ..... A47B 88/931
9,149,112 B2 * 10/2015 Yeh ..... A47B 31/00
9,845,562 B2 * 12/2017 Doyle ..... D06F 39/12
11,293,132 B2 * 4/2022 Kim ..... D06F 29/02
2004/0154194 A1 8/2004 Prows
2005/0274712 A1 * 12/2005 Gagas ..... F24C 7/087 219/385
2005/0278972 A1 * 12/2005 Maruca ..... D06F 58/20 34/212
2006/0278629 A1 * 12/2006 Gagas ..... H05B 6/6408 236/1 C
2007/0151041 A1 * 7/2007 McAllister ..... D06F 43/002 8/149.1
2007/0151120 A1 * 7/2007 Tomasi ..... D06F 58/10 38/14
2007/0151129 A1 * 7/2007 McAllister ..... D06F 39/088 38/3
2007/0151300 A1 * 7/2007 Sunshine ..... D06F 31/00 68/3 R
2007/0158327 A1 * 7/2007 Morrow ..... A47J 27/004 219/412
2007/0158331 A1 * 7/2007 Morrow ..... A47B 77/08 219/412
2008/0023462 A1 * 1/2008 Shei ..... F24C 7/087 219/394
2008/0052950 A1 * 3/2008 Park ..... D06F 39/125 34/524
2008/0053162 A1 * 3/2008 Park ..... D06F 39/125 68/13 R
2008/0053163 A1 * 3/2008 Park ..... D06F 58/10 68/13 R
2008/0053164 A1 * 3/2008 Park ..... D06F 29/005 68/13 R
2008/0053166 A1 * 3/2008 Lim ..... D06F 29/005 68/5 C
2008/0159907 A1 * 7/2008 Joshi ..... A61L 2/24 422/5
2008/0163651 A1 * 7/2008 Jeong ..... D06F 58/10 68/5 C
2008/0168675 A1 7/2008 Garman
2008/0282745 A1 * 11/2008 Han ..... D06F 58/203 68/20
2009/0193856 A1 * 8/2009 Park ..... D06F 58/10 68/27
2009/0235551 A1 * 9/2009 Jo ..... D06F 29/00 34/427
2009/0277036 A1 * 11/2009 Lee ..... D06F 39/125 34/239
2009/0277037 A1 * 11/2009 Lim ..... D06F 58/10 34/239
2010/0005681 A1 * 1/2010 Jo ..... D06F 39/125 34/215
2010/0011609 A1 * 1/2010 Park ..... D06F 25/00 34/88
2010/0281929 A1 * 11/2010 Han ..... D06F 29/00 34/524
2011/0002810 A1 * 1/2011 Watson ..... A61L 2/202 422/5
2011/0030428 A1 * 2/2011 Han ..... D06F 29/00 68/5 R
2011/0047814 A1 * 3/2011 Watson ..... F26B 21/10 34/562
2011/0067457 A1 * 3/2011 Han ..... D06F 29/005 68/13 R
2011/0232122 A1 * 9/2011 Butler ..... F26B 9/003 34/90
2011/0271551 A1 * 11/2011 Pearce ..... A61L 2/26 34/492
2011/0315783 A1 * 12/2011 Baker ..... B01L 1/025 236/3
2012/0055039 A1 * 3/2012 Watson ..... D06F 34/26 34/218
2013/0118470 A1 * 5/2013 Armstrong ..... F24C 15/16 29/458

(56) References Cited

U.S. PATENT DOCUMENTS

| | | | | |
|---|---|---|---|---|
| 2013/0118475 | A1* | 5/2013 | Armstrong | F24C 15/16 126/337 R |
| 2014/0138323 | A1* | 5/2014 | Jones | B25J 11/00 210/324 |
| 2014/0238087 | A1* | 8/2014 | Bae | D06F 29/005 68/27 |
| 2014/0238088 | A1* | 8/2014 | Bae | D06F 29/005 68/27 |
| 2015/0060432 | A1* | 3/2015 | Chung | F24C 15/322 219/393 |
| 2015/0257431 | A1 | 9/2015 | Ha | |
| 2015/0305093 | A1* | 10/2015 | Smith | H05B 3/26 219/391 |
| 2016/0273152 | A1* | 9/2016 | Farris | D06F 73/02 |
| 2017/0002503 | A1* | 1/2017 | Jeong | D06F 39/083 |
| 2017/0035244 | A1* | 2/2017 | Chatot | A23L 5/17 |
| 2017/0260681 | A1* | 9/2017 | Gao | D06F 58/10 |
| 2018/0187364 | A1* | 7/2018 | Kim | D06F 58/20 |
| 2018/0216833 | A1* | 8/2018 | Baker | F24C 15/04 |
| 2018/0347102 | A1* | 12/2018 | Um | D06F 58/10 |
| 2018/0347103 | A1* | 12/2018 | Lee | D06F 29/005 |
| 2019/0330791 | A1* | 10/2019 | Nam | D06F 58/16 |

FOREIGN PATENT DOCUMENTS

| | | | |
|---|---|---|---|
| CN | 203065849 | | 7/2013 |
| CN | 207277027 | U | 4/2018 |
| CN | 207362539 | | 5/2018 |
| EP | 1 959 050 | | 8/2008 |
| EP | 2 712 953 | A1 | 4/2014 |
| EP | 3 409 826 | | 12/2018 |
| GB | 2511433 | A | 9/2014 |
| JP | 02-119900 | | 5/1990 |
| JP | 2001-113098 | | 4/2001 |
| JP | 2001-120899 | A | 5/2001 |
| KR | 2003-0068489 | A | 8/2003 |
| KR | 10-2009-0109949 | A | 10/2009 |
| KR | 10-2009-0126134 | A | 12/2009 |
| KR | 10-1321527 | B1 | 10/2013 |
| KR | 10-2014-0058763 | | 5/2014 |
| KR | 10-1522199 | B1 | 5/2015 |
| KR | 10-2015-0138016 | A | 12/2015 |

OTHER PUBLICATIONS

European Patent Search Report issued in counterpart European Patent Application No. 19177618.6-1007 dated Aug. 21, 2019 (13 pages).

PCT International Search Report issued in PCT/KR2019/006575 mailed Sep. 25, 2019 (10 pages).

* cited by examiner

LAUNDRY TREATMENT APPARATUS

CROSS REFERENCES TO RELATED APPLICATIONS

This application is a continuation of U.S. patent application Ser. No. 16/428,421, filed on May 31, 2019, which claims the benefit of Korean Patent Application Nos. 10-2018-0063395, 10-2018-0063396, and 10-2018-0063397 filed on Jun. 1, 2018, all of which are hereby incorporated by reference in their entirety.

BACKGROUND OF THE INVENTION

Field of the Invention

The present invention relates to a laundry treatment apparatus.

Discussion of the Related Art

Generally, the laundry treatment apparatus conceptually covers an apparatus for washing laundry (clothes and the like), an apparatus for drying objects to be dried, and an apparatus for washing and drying clothes.

The laundry treatment apparatus includes a cabinet, a drum rotatably positioned in the cabinet to provide a space for storing clothes, and an air supply unit configured to supply heated air to the drum. The laundry treatment apparatus having such a structure removes moisture from clothes by supplying heated air to the clothes while stirring the clothes by rotating the drum. However, since the laundry treatment apparatus having such a structure supplies heated air while rotating the drum, the clothes may remain wrinkled.

In order to address the wrinkling, a conventional laundry treatment apparatus includes a drying chamber for providing a drying space, a plurality of racks positioned inside the drying chamber to provide a space where clothes are seated, and an air supply unit configured to supply heated air to the drying chamber. Conventional laundry treatment apparatuses equipped with racks may minimize wrinkles remaining on the clothes, but hardly secure a space where a large amount of clothes can be dried.

Multiple racks may be positioned in the drying chamber to dry a large amount of clothes at one time. However, in this case, it is difficult to uniformly supply heated air to the multiple racks. That is, when multiple racks are positioned in the drying chamber, clothes placed on certain racks may be damaged due to overdrying, and clothes placed on other racks may not be dried.

SUMMARY OF THE INVENTION

Accordingly, the present invention is directed to a laundry treatment apparatus that substantially obviates one or more problems due to limitations and disadvantages of the related art.

An object of the present invention is to provide a laundry treatment apparatus capable of drying a large amount of clothes at one time by providing multiple racks in a drying chamber and supplying air evenly to the respective racks.

Another object of the present invention is to provide a laundry treatment apparatus with a rack capable of preventing or minimizing exposure of a film of a thermoplastic resin formed on a mesh of the rack to the outside.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages, and in accordance with the purpose of the invention, as embodied and broadly described herein, a laundry treatment apparatus includes a cabinet having an entrance, a drawer configured to be drawn out from the cabinet through the entrance, the drawer comprising a drying chamber, a bottom surface, a front surface extending upward from the bottom surface, a rear surface fixed to the bottom surface and at a position facing the front surface, and first and second side surfaces fixed to the bottom surface to connect the front surface and the rear surface, a first rack disposed in the drying chamber, the first rack comprising a first vent portion providing a space for supporting clothes and allowing a space above the first rack to communicate with a space below the first rack, a second rack disposed in the drying chamber and positioned between the first rack and the bottom surface, the second rack comprising a second vent portion providing a space for supporting clothes and allowing a space above the second rack to communicate with a space below the second rack, a supply port formed to penetrate the rear surface, an air supply unit located outside the drying chamber at a higher position than the supply port, and a guide in the supply port to guide air supplied from the air supply unit to at least one of a space between the first rack and the second rack and a space between the second rack and the bottom surface.

The guide may include a first guide in the supply port to guide air into the space between the second rack and the bottom surface, and a second guide in the supply port to guide air into the space between the first rack and the second rack.

The first guide may include a first first-guide board in a width direction of the rear surface, and a second first-guide board in the width direction of the rear surface and located over the first first-guide board, wherein an inclination angle of an upper surface of the first first-guide board may be greater than an inclination angle of an upper surface of the second first-guide board.

The second guide may include a first second-guide board in the width direction of the rear surface and located over the second first-guide board, and a second second-guide board in the width direction of the rear surface and located over the first second-guide board, wherein an inclination angle of an upper surface of the first second-guide board may be greater than an inclination angle of an upper surface of the second second-guide board and less than the inclination angle of the upper surface of the second first-guide board.

The guide may further include a third guide in the supply port to guide air to the space above the first rack.

The third guide may include a first third-guide board in the width direction of the rear surface and located over the second second-guide board, and a second third-guide board in the width direction of the rear surface and located over the first third-guide board, wherein an inclination angle of an upper surface of the first third-guide board is greater than an inclination angle of an upper surface of the second third-guide board and less than the inclination angle of the upper surface of the second second-guide board.

The laundry treatment apparatus may further include a support body positioned in the space between the second rack and the bottom surface to provide a space for supporting clothes, a plurality of protrusions protruding from the support body toward the bottom surface to maintain a gap between the support body and the bottom surface, and a support body through hole formed to penetrate the support body.

The laundry treatment apparatus may further include a duct inclined upward from the supply port toward the air supply unit to guide air discharged from the air supply unit to the supply port.

The air supply unit may include a first housing having a first inlet provided on a surface facing the first side surface and a first outlet provided on a surface facing the rear surface, the first outlet communicating with the duct, a first impeller rotatably positioned in the first housing to discharge air introduced into the first inlet to the first outlet, a second housing having a second inlet provided on a surface facing the second side surface and a second outlet provided on a surface facing the rear surface, the second outlet communicating with the duct, a second impeller rotatably positioned in the second housing to discharge air introduced into the second inlet to the second outlet, and a heater configured to heat at least one of air moving to the first inlet and air moving to the second inlet.

An inclination angle of the duct with respect to the rear surface may be set within a range of 30 to 60 degrees.

The laundry treatment apparatus may further include a rear through hole formed to penetrate a rear surface of the cabinet, and a cabinet cover fixed to the rear surface of the cabinet to close the rear through hole and concavely bent in a direction away from the rear surface of the cabinet providing a space for accommodating the air supply unit.

The laundry treatment apparatus may further include a cover through hole formed to penetrate the cabinet cover, wherein the heater may be configured to heat air flowing into one of the first inlet and the second inlet located closer to the cover through hole than the other one of the first inlet and the second inlet.

The laundry treatment apparatus may further include an introduction port provided in a top surface of the drawer and allowing the drying chamber to communicate with an interior of the cabinet, and a plurality of cover through holes formed to penetrate the cabinet cover, wherein the air supply unit may supply the drying chamber with a part of air discharged into the cabinet through the introduction port.

The amount of air discharged from the drying chamber and supplied to the air supply unit may be greater than the amount of air supplied to the air supply unit through the cover through holes.

The ratio of the amount of air discharged from the drying chamber and supplied to the air supply unit to the amount of air supplied to the air supply unit through the cover through holes may be 6:4.

In another aspect of the present invention, provided herein is a laundry treatment apparatus including a cabinet having an entrance; a drawer configured to be drawn out from the cabinet through the entrance, a drying chamber; an air supply unit configured to supply air into the drying chamber; and a rack disposed in the drying chamber to provide a space for supporting clothes, wherein the rack includes a mesh providing a space for supporting the clothes and allowing a space located above the rack to communicate with a space located below the rack, a mesh frame for fixing an edge of the mesh, a rack frame configured to provide a space for coupling the mesh frame and prevent a joint between the mesh and the mesh frame from being exposed to the outside; and a frame through hole formed to penetrate the rack frame to provide a space in which the mesh is positioned when the mesh frame is coupled to the rack frame.

The mesh frame may be coupled with the edge of the mesh through insert injection molding by supplying a thermoplastic resin along the edge of the mesh.

The rack frame may include a frame first body defining a lower surface of the rack; a second frame body coupled to an upper portion of the first frame body to form an upper surface of the rack; and an accommodation portion provided in at least one of the first frame body and the second frame body to provide a space for accommodating the mesh frame, wherein the frame through hole may include a first body through hole formed to penetrate the first frame body, and a second body through hole formed to penetrate through the second frame body to communicate with the first body through hole.

The accommodation portion may include a first accommodation portion formed in the frame body to provide a space for accommodating a lower area of the mesh frame; and a second accommodation portion formed in the second frame body to provide a space for accommodating an upper area of the mesh frame.

The drying chamber may include a bottom surface; a front surface extending upward from the bottom surface, a rear surface fixed to the bottom surface and at a position facing the front surface, and first and second side surfaces fixed to the bottom surface to connect the front surface and the rear surface, wherein the air supply unit may be fixed to the rear side and located outside the drying chamber, and configured to supply air into the drying chamber through a supply port formed to penetrate the rear surface.

The present invention may include a first shaft protruding from the first side surface toward the second side surface; a second shaft protruding from the second side surface toward the first side surface and positioned on a straight line passing through the first shaft; a first shaft fastening portion provided on a surface of the rack frame facing the first side surface to provide a space for accommodating the first shaft; a second shaft fastening portion provided on a surface of the rack frame facing the second side surface to provide a space for accommodating the second shaft; a rack support protruding from the front surface toward the rear surface to support one end of the rack frame; and an insulator provided to the rack frame and seated on the rack support, the insulator being formed of an elastic material.

The present invention may further include an insulator insertion groove provided in a bottom surface of the first frame body to provide a space for accommodating the insulator; a fastening hole located in the insulator insertion groove and formed to penetrate the frame body; a fastening groove protruding from the second frame body toward the fastening hole; and a fastening portion coupled to the fastening groove through the fastening hole to couple the first frame body and the second frame body.

The mesh frame may be drawn out from the rack frame.

The rack frame may include a front frame forming a front surface; a rear frame forming a rear surface; a first side frame and a second side frame connecting the front frame and the rear frame; a slit formed to penetrate the front frame to allow the frame through hole to communicate with the outside; and a frame guide provided to at least one of the rear frame, the first side frame, and the second side frame to support the mesh frame.

A length of the front frame with respect to an insertion direction of the mesh frame may be set to be greater than a length of the front surface of the mesh frame with respect to the insertion direction of the mesh frame.

The frame guide may include a first side guide provided with a groove formed by concavely bending a surface of the first side frame in a direction away from the second side frame to provide a space for accommodating the first side surface of the mesh frame; and a second side guide provided with a groove formed by concavely bending a surface of the mesh frame in a direction away from the first side frame to provide a space for accommodating a second side surface of the second side frame (the surface facing the first side surface of the mesh frame).

A depth of the first side guide facing away from the second side frame may be set to be greater than a width of the first side surface of the mesh frame, and a depth of the second side guide facing away from the first side frame may be set to be greater than a width of the second side surface of the mesh frame.

The frame guide may include a rear guide provided to the rear frame to provide a space into which the rear surface of the mesh frame is inserted.

The rear guide may be formed as a rear frame through hole formed to penetrate the rear frame, or a groove formed by concavely bending the surface of the rear frame in a direction away from the front frame.

A length of the rear guide with respect to the insertion direction of the mesh frame may be set to be greater than a length of the rear surface of the mesh frame with respect to the insertion direction of the mesh frame.

In another aspect of the present invention, provided herein is a cabinet having an entrance, a drawer configured to be drawn out from the cabinet through the entrance, the drawer comprising: a drying chamber, a bottom surface, a front surface extending upward from the bottom surface, a rear surface fixed to the bottom surface and at a position facing the front surface, and first and second side surfaces fixed to the bottom surface to connect the front surface and the rear surface; a supply port formed to penetrate the rear surface; an air supply unit fixed to the rear surface and located outside the drying chamber to supply air into the drying chamber through the supply port; a heating plate formed of a conductor and forming at least a part of the bottom surface; and a heating element located between the bottom surface and the heating plate and configured to generate heat when electric current is supplied thereto.

An area of the heating plate may be set to 80% or more of an area of the bottom surface.

The heating plate may further include an accommodation groove protruding in a direction away from the bottom surface to provide a space for accommodating the heating element.

The present invention may further include a rack disposed in the drying chamber; and a mesh on the rack to provide a space for supporting the clothes and having a plurality of holes allowing a space above the rack to communicate with a space below the rack, wherein the supply port may be located between the rack and the bottom surface.

The rack may include a first rack disposed in the drying chamber, the first rack providing a space for supporting clothes; and a second rack disposed in the drying chamber, the second rack providing a space for supporting clothes, and a second rack positioned between the first rack and the heating plate, wherein the supply port may be located between the second rack and the heating plate.

The present invention may further include a support body positioned between the rack and the bottom surface to provide a space for supporting the clothes; a plurality of protrusions protruding from the support body toward the heating plate so as to maintain a gap between the support body and the heating plate; and a support body through hole formed to penetrate the support body.

The present invention may further include a guide for guiding part of air discharged from the supply port to a space between the support body and the heating plate.

The heating element may include a first heating element extending from the rear surface toward the front surface; a second heating element extending from the rear surface toward the front surface and disposed at a position spaced apart from the first heating element; a third heating element extending from the front surface toward the rear surface, the third heating element being positioned between the first heating element and the second heating element; a fourth heating element extending from the front surface toward the rear surface, the fourth heating element being positioned between the third heating element and the second heating element; a first connection heating element for connecting the first heating element and the third heating element; a second connection heating element for connecting the third heating element and the fourth heating element; a third connection heating element for connecting the fourth heating element and the second heating element; a first terminal provided to the first heating element and exposed to the outside of the drying chamber through the rear surface; and a second terminal provided to the second heating element and exposed to the outside of the drying chamber through the rear surface.

The supply port may include a first supply port configured to supply air to a space between the first heating element and the third heating element; and a second supply port configured to supply air to a space between the fourth heating element and the second heating element, wherein the air supply part may include a first impeller for discharging air to the first supply port; and a second impeller for discharging air to the second supply port.

The present invention may further include a mesh frame for fixing an edge of the mesh, wherein the rack may include a rack frame to which the mesh frame is withdrawably fixed; and a frame through hole formed to penetrate the rack frame to provide a space in which the mesh is positioned when the mesh frame is inserted into the rack frame.

The rack frame may include a front frame forming a front surface; a rear frame forming a rear surface; a first side frame and a second side frame connecting the front frame and the rear frame; a slit formed to penetrate the front frame to allow the frame through hole to communicate with the outside; and a frame guide provided to at least one of the rear frame, the first side frame, and the second side frame to support the mesh frame.

A length of the front frame with respect to an insertion direction of the mesh frame may be set to be greater than a length of the front surface of the mesh frame with respect to the insertion direction of the mesh frame.

The frame guide may include a first side guide provided with a groove formed by concavely bending a surface of the first side frame in a direction away from the second side frame to provide a space for accommodating the first side surface of the mesh frame; and a second side guide provided with a groove formed by concavely bending a surface of the mesh frame in a direction away from the first side frame to provide a space for accommodating a second side surface of the second side frame.

A depth of the first side guide facing away from the second side frame may be set to be greater than a width of the first side surface of the mesh frame, and a depth of the second side guide facing away from the first side frame may be set to be greater than a width of the second side surface of the mesh frame.

The frame guide may include a rear guide provided to the rear frame to provide a space into which the rear surface of the mesh frame is inserted.

The rear guide may be formed as a rear frame through hole formed to penetrate the rear frame, or a groove formed by concavely bending the surface of the rear frame in a direction away from the front frame.

A length of the rear guide with respect to the insertion direction of the mesh frame may be set to be greater than a length of the rear surface of the mesh frame with respect to the insertion direction of the mesh frame.

It is to be understood that both the foregoing general description and the following detailed description of the present invention are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and, together with the description, serve to explain the principle of the invention. In the drawings.

DETAILED DESCRIPTION OF THE INVENTION

Hereinafter, preferred embodiments of the present invention will be described in detail with reference to the accompanying drawings. It is to be understood that the description of a configuration of an apparatus and a control method given below is exemplary and explanatory only, and is not restrictive of the scope of the invention. Wherever possible, the same reference numbers will be used throughout the drawings to refer to the same or like parts.

Figure 1:
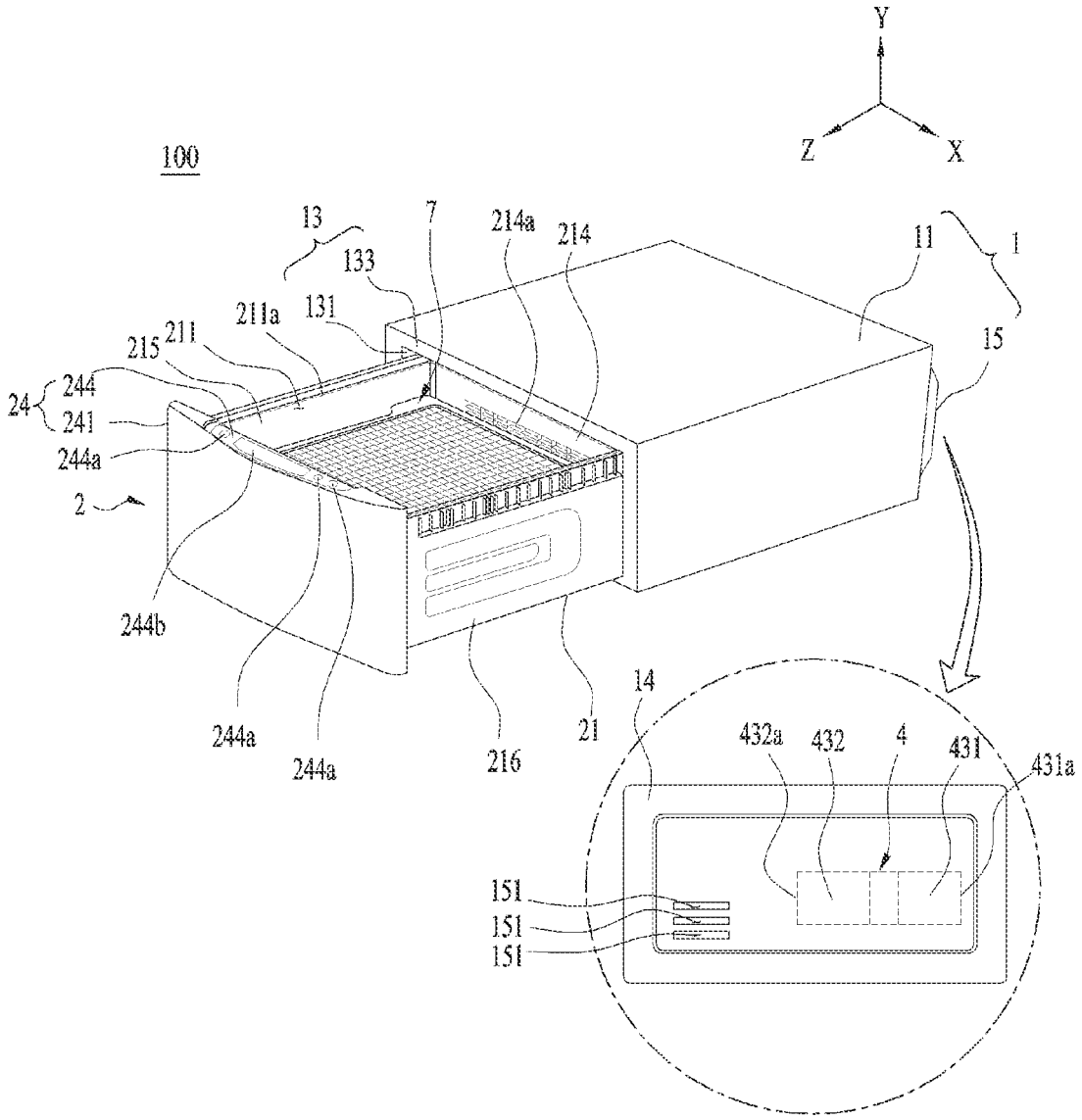
FIG. 1 shows an example of a laundry treatment apparatus according to the present invention.

As shown in FIG. 1, a laundry treatment apparatus 100 according to the present invention includes a cabinet 1, a drawer 2 positioned in the cabinet 1 so as to be drawn out, a drying chamber 211 positioned in the drawer to provide a drying space, at least one rack 7 positioned inside the drying chamber 211 to provide a space for supporting clothes, and an air supply unit 4 configured to supply heated air (hot air) or non-heated air to the drying chamber 211.

The cabinet 1 includes a cabinet body 11 configured to provide a space for accommodating the drawer 2, and an entrance 131 provided in a front face 13 of the cabinet body 11 to provide a passage through which the drawer 2 is drawn out from the cabinet body 11 or inserted into the cabinet body 11. When the entire cabinet front face 13 is provided as an open face, the entrance 131 will be the cabinet front face 13. However, when the entrance 131 is provided as a hole penetrated through a part of the cabinet front face 13, a stopper 133 for supporting a panel 24 provided on the drawer 2 may be provided at the edge of the entrance 131.

A rear face 14 of the cabinet 1 is provided with a cabinet cover 15 detachably coupled to the cabinet body 11. The cabinet cover 15 is detachably coupled to the cabinet body 11 in order to facilitate access to the back of the drawer 2 or to devices positioned inside the cabinet body 11.

The cabinet cover 15 may be provided with a plurality of cover through holes 151. The cover through holes 151 are means for supplying external air into the cabinet 1. The air supply unit 4 may supply external air to the drying chamber 211 through the cover through holes 151.

Figure 2:
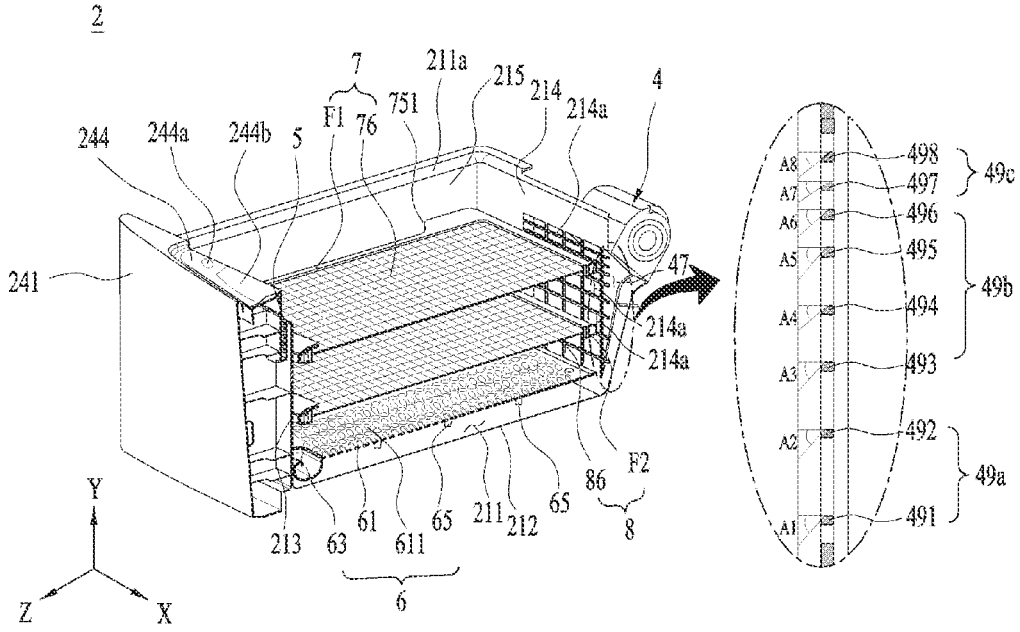
FIGS. 2 and 3 show exemplary cross-sectional views of the laundry treatment apparatus of the present invention.

The drawer 2 includes a body 21 configured to be drawn out from the cabinet body 11 through the entrance 131. The drying chamber 211 is provided in the body 21. That is, as shown in FIG. 2, the drying chamber 211 may include a bottom surface 212, a front surface 213 extending upward from the bottom surface 212, a rear surface 214 fixed to the bottom surface 212 and provided at a position facing the front surface 213, and a first side surface 215 and a second side surface 216 fixed to the bottom surface 212 to connect the front surface 213 and the rear surface 214.

The top surface of the drying chamber 211 is provided with an introduction port 211*a* through which the clothes enter and exit. The introduction port 211*a* may be formed as an open top surface of the drying chamber 211 or as a hole penetrated through a part of the top surface of the drying chamber 211. The introduction port 211*a* is exposed to the outside of the cabinet 1 when a user draws the body 21 out of the cabinet 1.

The panel 24 is fixed to the body 21. The panel 24 may include a panel body 241 capable of closing the entrance 131. That is, the panel body 241 may be formed to be capable of closing the entrance 131 when the body 21 is inserted into the cabinet 1. In this case, the panel body 241 is positioned outside the cabinet 1 even when the body 21 is inserted into the cabinet 1. Thus, the panel body 241 may also serve as a handle of the body 21.

The panel body 241 may include a control panel 244. The control panel 244 may include an input unit 244*a* and a display unit 244*b*. The input unit 244*a* is a means for inputting a control command to the laundry treatment apparatus 100, and the display unit 244*b* is a means for displaying control commands selectable by a user and an execution process of a selected control command.

Figure 3:
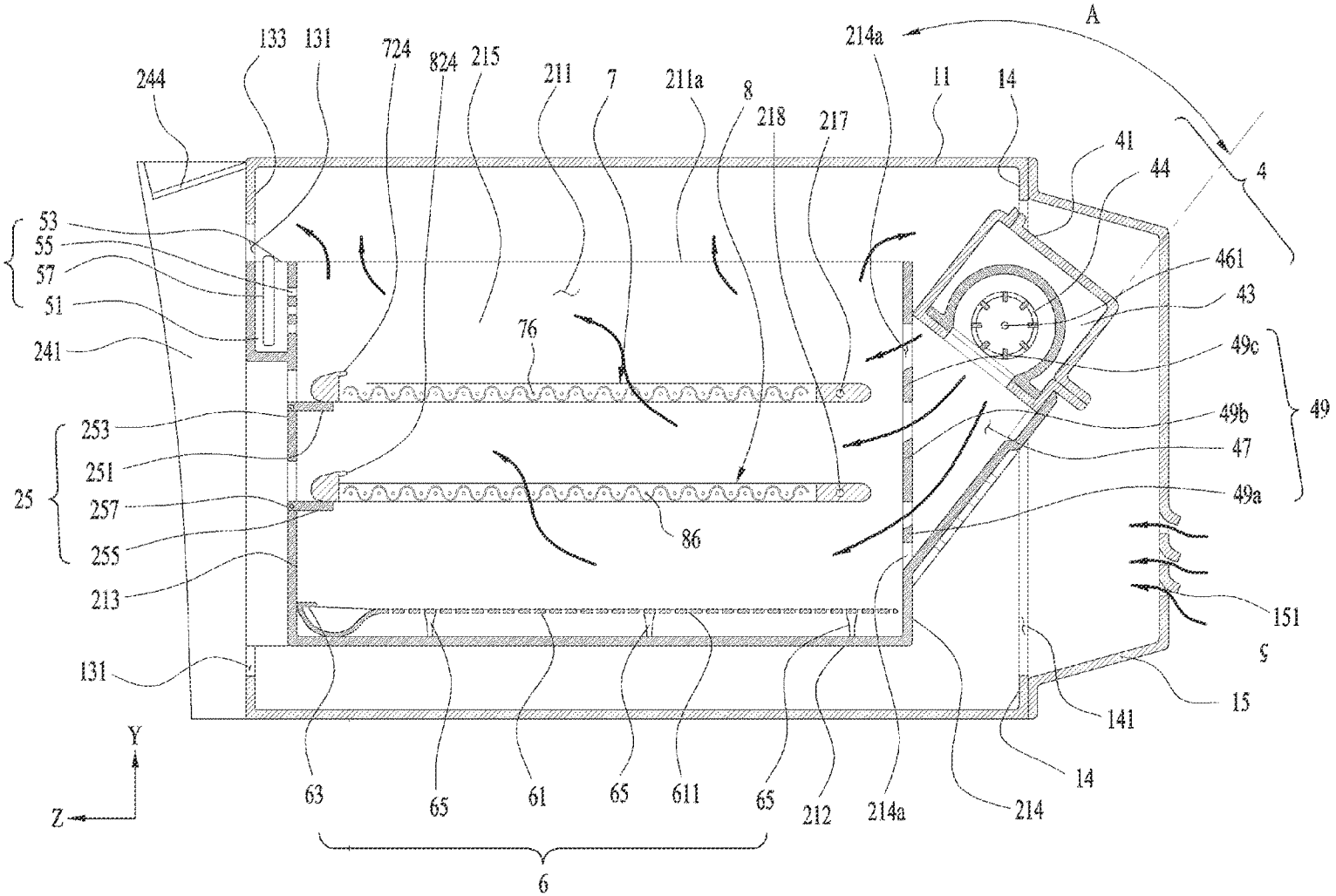

As shown in FIG. 3, a rack for providing a space for storing clothes is positioned in the drying chamber 211. The rack may include a first rack (upper rack) 7 located inside the drying chamber 211, and a second rack (lower rack) 8 located between the first rack 7 and the bottom surface 212. The first rack 7 is provided with a first vent portion 76 allowing the space of the drying chamber 211 located above the first rack 7 to communicate with the space of the drying chamber 211 located below the first rack 7. The second rack 8 is provided with a second vent portion 86 allowing the space of the drying chamber 211 located above the second rack 8 to communicate with the space of the drying chamber 211 located below the second rack 8. The first vent portion 76 and the second vent portion 86 may have any shape, structure, and material as long as they can implement the functions described above. In FIG. 3, the vent portions 76 and 86 are illustrated as being configured as a mesh having multiple holes (mesh holes).

The first vent portion 76 is provided in holes penetrating the first rack 7 to provide a space for supporting clothes, and the second vent portion 86 is provided in holes penetrating the second rack 8 to provide a space for supporting clothes. Accordingly, while the inside of the drying chamber 211 is divided into separate spaces by the first rack 7 and the second rack 8, the vent portions 76 and 86 may allow the spaces to communicate with each other. The first rack 7 and the second rack 8 may have the same structure, which will be described in detail later.

The first rack 7 and the second rack 8 may be positioned to be rotated toward the introduction port 211*a* with respect to shafts provided on the first side surface 215 and the second side surface 216 (see FIG. 1) of the drying chamber 211. That is, the first rack 7 may be rotated toward the introduction port 211*a* by a first first-rack shaft 217 provided on the first side surface 215 and a second first-rack shaft (not shown) provided on the second side surface 216, and the second rack 8 may be rotated toward the introduction port 211*a* in the drying chamber 211 by a first second-rack shaft 218 (positioned under the first first-rack shaft) provided on the first side surface 215 and a second second-rack shaft (not shown) provided on the second side surface 216. The first rack 7 should be rotatable toward the introduction port 211*a* to allow the user to place clothes on the second rack 8. The second rack 8 should be rotatable toward the introduction port 211*a* to allow the user to place clothes on the bottom surface 212.

When the first rack 7 and the second rack 8 are rotatably positioned in the drying chamber 211, a rack support 25 for supporting the free ends of the racks may be provided on the front surface 213 of the drying chamber 211. The rack support 25 may include a first support 251 for supporting the free end of the first rack 7 and a second support 255 for supporting the free end of the second rack 8.

The first support 251 may be rotatably coupled to the front surface 213 through a first support shaft 253 so as not to interfere with rotation of the second rack 8 when the second rack 8 rotates toward the introduction port 211*a*. The front surface 213 may be provided with a first accommodation groove (accommodation hole) 213*a* providing a space for accommodating the first support 251.

A spacer 6 may be further provided in the space between the second rack 8 and the bottom surface 212 such that clothes introduced into the space below the second rack 8 can be easily dried. The spacer 6 is positioned spaced apart from the bottom surface 212 to provide a space in which clothes are placed.

The spacer 6 may include a support body 61 disposed in the space between the second rack 8 and the bottom surface 212 to provide a space for supporting the clothes, a plurality of protrusions 65 protruding from the support body 61 toward the bottom surface 212 so as to maintain a gap between the support body 61 and the bottom surface 212, and a support body through hole 611 formed to penetrate the support body 61.

The spacer 6 may be further provided with a spacer handle 63 concavely from the support body 61 toward the bottom surface 212. The length from the surface of the support body 61 to the end of the spacer handle 63 may be equal to the length from the surface of the support body 61 to the end of the protrusion 65.

The second support 255 may be rotatably coupled to the front surface 213 through a second support shaft 257 to facilitate mounting the spacer 6 in the space located below the second rack 8. The front surface 213 may be provided with a second accommodation groove (or accommodation hole) 213*b* for accommodating the second support 255.

The clothes placed on the racks 7 and 8 and the spacer 6 are dried by hot air or non-heated air supplied from the air supply unit 4 to the drying chamber 211. Hereinafter, it is assumed that the air supply unit 4 is configured to supply hot air.

The air supply unit 4 supplies hot air to the drying chamber 211 through supply ports 214*a* formed through the surface of the drying chamber 211 in a penetrating manner. In FIG. 3, the supply ports 214*a* are illustrated as being holes formed by penetrating the rear surface 214.

The air supply unit 4 may be located outside the drying chamber 211 at a higher position than the supply ports 214*a*. Air discharged from the air supply unit 4 may be supplied to the supply ports 214*a* through a duct 47, which is inclined upward from the supply ports 214*a* toward the air supply unit 4.

The cabinet cover 15 is fixed to the cabinet rear face 14 so as to close the rear through hole 141 formed to penetrate the cabinet rear face 14 and to extend away from the cabinet rear face 14 in a bent manner. Accordingly, when the drawer 2 is inserted into the cabinet 1, the cabinet cover 15 will provide a space in which the air supply unit 4 is accommodated.

Figure 4:
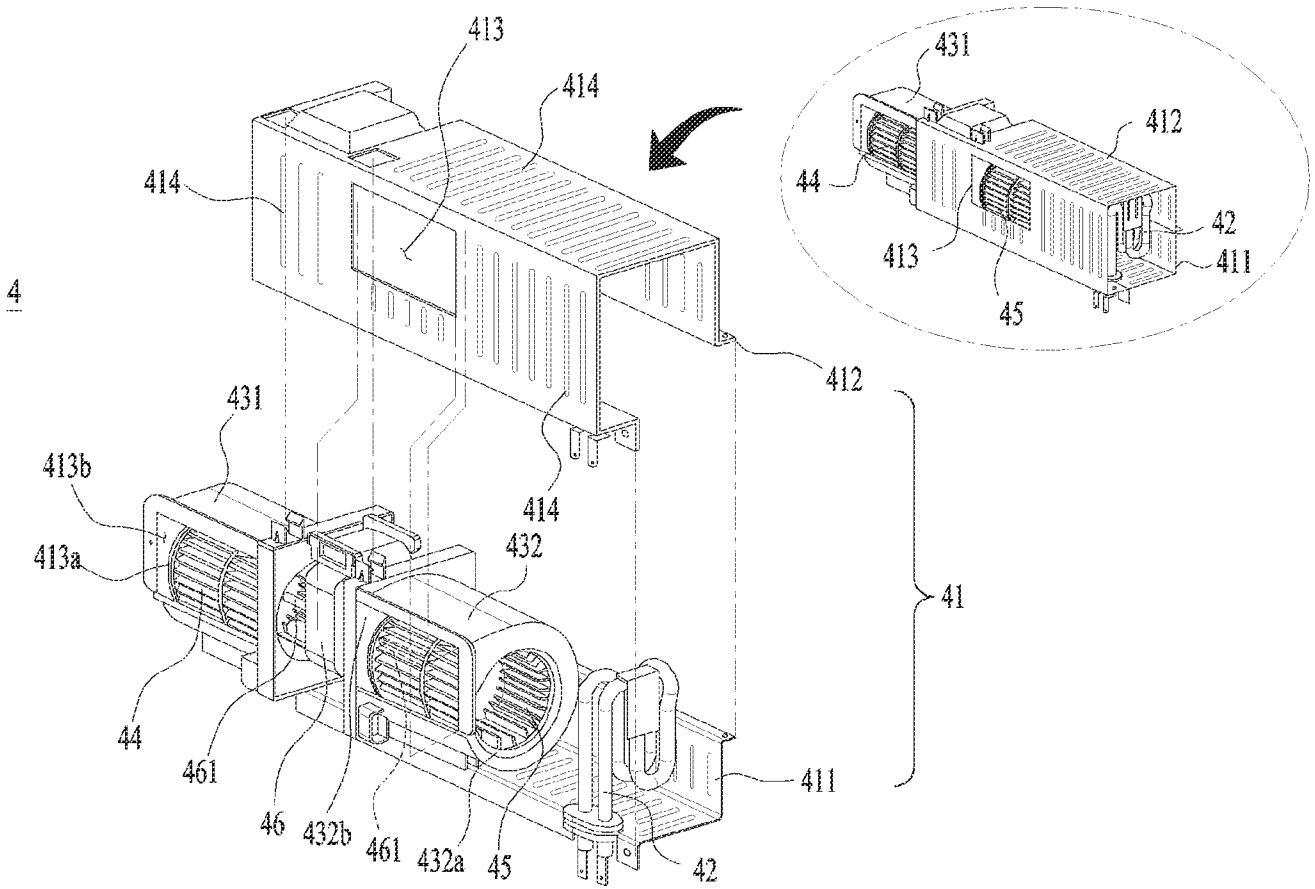
FIG. 4 shows an example of an air supply unit provided in the present invention.

As shown in FIG. 4, the air supply unit 4 includes a heating unit 41, 42 configured to heat air, and a fan 431, 432, 44, 45, 46 configured to supply air to the drying chamber 211.

The fan may include a housing communicating with the drying chamber 211 through the duct 47, a first impeller 44 and a second impeller 45 positioned in the housing, and a motor 46 having a rotary shaft 461 configured to rotate the impellers 44, 45. The housing may include a first housing 431 for providing a space for accommodating the first impeller 44 and a second housing 432 for providing a space for accommodating the second impeller 45.

The first impeller 44 and the second impeller 45 may be provided as centrifugal impellers configured to suction air through a rotation center and discharge air through a circumferential surface, and the first housing 431 and the second housing 432 may be cylindrically formed to accommodate the respective impellers 44, 45. The first housing 431 may include a first inlet 431*a* provided in one surface thereof facing the first side surface 215 of the drying chamber 211, and a first outlet 431*b* provided in a circumferential surface thereof facing the rear surface 214 of the drying chamber 211 to communicate with the duct 47. The second housing 432 may include a second inlet 432*a* provided in one surface thereof facing the second side surface 216 of the drying chamber 211, and a second outlet 432*b* provided in a circumferential surface thereof facing the rear surface 214 of the drying chamber 211 to communicate with the duct 47.

The heating unit may include a heating unit housing 41 fixed to the housings 431 and 432, and a heater 42 fixed to the heating unit housing 41. The heating unit housing 41 may include portion 43 and be fixed to one of the first housing 431 and the second housing 432. As shown in FIG. 4, the heating unit housing 41 may include a base 411 coupled to the second housing 432 to provide a space for fixing the heater 42, and a base cover 412 coupled to the base 411 to define a flow passage communicating with the second inlet 432*a*. Since the heater 42 is located inside the flow passage defined by the base 411 and the base cover 412, the heater 42 may heat air moving to the second inlet 432*a*.

The base cover 412 serves not only as a means for defining the flow passage, but also as a means for preventing water or a combustible substance from contacting the heater 42 by preventing the heater 42 from being exposed to the outside. The base cover 412 may further include a plurality of cover slits 414 to smoothly supply air to the second inlet 432*a*. The cover slits 414 are formed by penetrating the base cover 412. Further, in case that the base cover 412 interferes with the second outlet 432*b* provided in the second housing 432, the base cover 412 should be further provided with a cover through hole 413 including hole portions 413*a*, 413*b* communicating with the second outlet 432*b*. The motor 46 may be a double shaft motor that rotates the two impellers 44 and 45 through the single rotary shaft 461.

As shown in FIG. 3, the first outlet 431*b* and the second outlet 432*b* of the air supply unit 4 are located at a higher position than a supply port 214*a* provided at the lowest position among the multiple supply ports 214*a*, and the duct 47 is inclined upward from the supply ports 214*a* toward the two outlets 431*b* and 432*b* to facilitate supply of hot air to the space between the first rack 7 and the second rack 8 and the space between the second rack 8 and the bottom surface 212.

As the inclination angle A of the duct 47 with respect to the rear surface 214 (the angle between the rear surface and a line passing through the center of each outlet) increases, the amount of air supplied to the space between the second rack 8 and the bottom surface 212 may be expected to increase. However, as the angle A increases, the amount of air supplied to the space between the first rack 7 and the second rack 8 and the space located above the first rack 7 may decrease, and the volume of a space required for installation of the air supply unit 4 on the rear surface 214 of the drawer 2 may increase. Accordingly, the inclination angle A of the duct 47 with respect to the rear surface 214 needs to be properly set. According to experimentation, the above-mentioned advantage may be maximized and the disadvantage may be minimized when the angle A is set within a range of 30 to 60 degrees.

In order to supply air evenly to the space between the first rack 7 and the second rack 8, the space between the second rack 8 and the spacer 6, and the space located above the first rack 7, a guide 49 may be further provided in the supply port 214*a*.

The guide 49 may include a first guide 49*a* positioned in the supply port 214*a* to guide air into the space between the second rack 8 and the spacer 6, and a second guide 49*b* provided in the supply port 214*a* to guide air into the space between the first rack 7 and the second rack 8.

The first guide 49*a* and the second guide 49*b* may be provided with one or more boards positioned in a width direction (X-axis direction) of the rear surface 214. FIG. 2 illustrates that the first guide 49*a* includes a first first-guide board 491 positioned in the width direction of the rear surface 214 and a second first-guide board 492 positioned in the width direction of the rear surface 214 and located over the first first-guide board 491.

The duct 47 provided in the present invention is inclined with respect to the rear surface 214 to guide the air discharged from the air supply unit 4 to the supply ports 214*a*. Accordingly, in order to uniformly supply air to the space between the second rack 8 and the bottom surface 212, the inclination angle A1 of the upper surface of the first first-guide board 491 may be set differently from the inclination angle A2 of the upper surface of the second first-guide board 492. In FIG. 2, it is illustrated that the inclination angle A1 of the upper surface of the first first-guide board 491 inclined downward toward the bottom surface 212 is set to be greater than the inclination angle A2 of the upper surface of the second first-guide board 492.

The second guide 49*b* may also include one or more boards. FIG. 2 illustrates that the second guide 49*b* includes a first second-guide board 493, a second second-guide board 494, a third second-guide board 495, and a fourth second-guide board 496, which are provided in the supply port 214*a* in the width direction (X-axis direction) of the rear surface 214.

The first second-guide board 493 may be located over the second first-guide board 492, and the second second-guide board 494 may be located over the first second-guide board 493. The third second-guide board 495 may be located over the second second-guide board 494, and the fourth second-guide board 496 may be located over the third second-guide board 495.

In this case, the inclination angle A3 of the upper surface of the first second-guide board 493 inclined downward toward the upper surface of the second rack 8 may be set to be greater than the inclination angle A4 of the upper surface of the second second-guide board 494 and set to be less than the inclination angle A2 of the upper surface of the second first-guide board 492.

The inclination angle A4 of the upper surface of the second second-guide board 494 may be set to be greater than the inclination angle A5 of the upper surface of the third second-guide board 495, and the inclination angle A5 of the upper surface of the third second-guide board 495 may be set to be greater than the inclination angle A6 of the upper surface of the fourth second-guide board 496.

The volume of the space formed between the first rack 7 and the second rack 8 and the volume of the space located above the first rack 7 may be set to be larger than the volume of the space located below the second rack 8, which may be advantageous in drying the clothes placed on the first rack 7 and the second rack 8.

The volume of the space formed between the first rack 7 and the second rack 8 may be set to be equal to the volume of the space located above the first rack 7 (wherein the distance between the first rack 7 and the second rack 8 may be set to be equal to the distance between the first rack 7 and the introduction port 211*a*).

The clothing supporting space formed above the first rack 7 may extend from the first rack 7 to the top surface of the cabinet body 11 due to the introduction port 211*a* formed in the top surface of the drying chamber 211. Accordingly, the volume of the space formed between the first rack 7 and the second rack 8 may be set to be larger than the volume of the space located above the first rack 7 (the distance between the first rack 7 and the second rack 8 may be set to be longer than the distance between the first rack 7 and the introduction port 211*a*).

The number of the boards 493, 494, 495, and 496 provided to the second guide 49*b* is set to be larger than the number of the boards 491 and 492 provided to the first guide 49*a*, such that air is evenly supplied to the entire space between the first rack 7 and the second rack 8, which is the largest space among the spaces, and thus the drying efficiency is improved.

The guide 49 may further include a third guide 49*c* for guiding air to the space located above the first rack 7. The third guide 49*c* may also have one or more boards positioned in the supply port 214*a* in the width direction (X-axis direction) of the drawer. In FIG. 2, it is illustrated that the third guide board 497 includes a first third-guide board 497 located over the fourth second-guide board 496, and a second third-guide board 498 located over the first third-guide board 497.

In this case, the inclination angle A7 of the upper surface of the first third-guide board 497, inclined downward toward the upper surface of the first rack 7, may be set to be greater than the inclination angle A8 of the upper surface of the second third-guide board 498. This is because supplying air toward the upper surface of the first rack 7 is advantageous for heat exchange between clothes and hot air. The inclination angle A7 of the upper surface of the first third-guide board 497 may be set to be less than the inclination angle A6 of the upper surface of the fourth second-guide board 496.

The heater 42 provided in the air supply unit 4 may be positioned to heat air flowing into an inlet closer to the cover through hole 151 between the first inlet 431*a* provided in the first housing 431 and the second inlet 432*a* provided in the second housing 432. That is, as shown in FIG. 1, when the second inlet 432*a* is closer to the cover through hole 151 and the other inlet, the heater 42 may be positioned to heat the air flowing into the second inlet 432*a*.

As shown in FIG. 3, the drying chamber 211 provided in the present invention is provided with the introduction port 211*a* in the top surface thereof. Accordingly, air having undergone heat exchange with the clothes is discharged into the cabinet 1 through the introduction port 211*a*, wherein a part of the air discharged into the cabinet 1 is discharged from the cabinet 1 through the entrance 131 or the like, and the rest of the air is re-supplied to the drying chamber 211 through the air supply unit 4.

The air discharged from the introduction port 211*a* is air that has finished heat exchange with clothes, but has a larger thermal energy than external air flowing in through the cover through hole 151. Accordingly, in the present invention, as the air supply unit 4 supplies a part of the air discharged through the introduction port 211*a* to the drying chamber 211, the energy required for the drying operation may be reduced (i.e., a laundry treatment apparatus having high drying efficiency may be provided).

To this end, the amount of air discharged from the drying chamber 211 and supplied to the air supply unit 4 may be set to be greater than the amount of air supplied to the air supply unit 4 through the cover through hole 151. According to experimentation, the best drying efficiency is obtained when the ratio of the amount of air discharged from the drying chamber 211 and supplied to the air supply unit 4 and the amount of air supplied to the air supply unit 4 through the cover through hole 151 is 60:40 to 55:45.

The amount of air discharged from the drying chamber 211 and supplied to the air supply unit 4 and the amount of air supplied to the air supply unit 4 through the cover through hole 151 may vary depending on the area of the introduction port 211*a*, the total area of the cover through hole 151, the area of the first inlet 431*a*, the area of the second inlet 432*a*, and the area of the supply port 214*a*.

The front surface 213 of the drying chamber 211 may further include an additive supply unit 5 configured to supply an additive to clothes. The additive referred to herein means a material which supplies the clothes with fragrance or removes odor from the clothes. An example may be a sheet-type air freshener. The additive supply unit 5 may include a mounting part 51 provided on the front surface 213 of the drying chamber 211, an insertion port 53 formed in the top surface of the mounting part 51, a communicating hole 55 formed through the front surface 213 to allow the mounting part 51 to communicate with the drying chamber 211, and a sheet-type additive 57 inserted into the mounting part 51.

Hereinafter, the structure of the first rack 7 and the second rack 8 provided in the present invention will be described in detail with reference to FIGS. 5 to 9.

Figure 5:
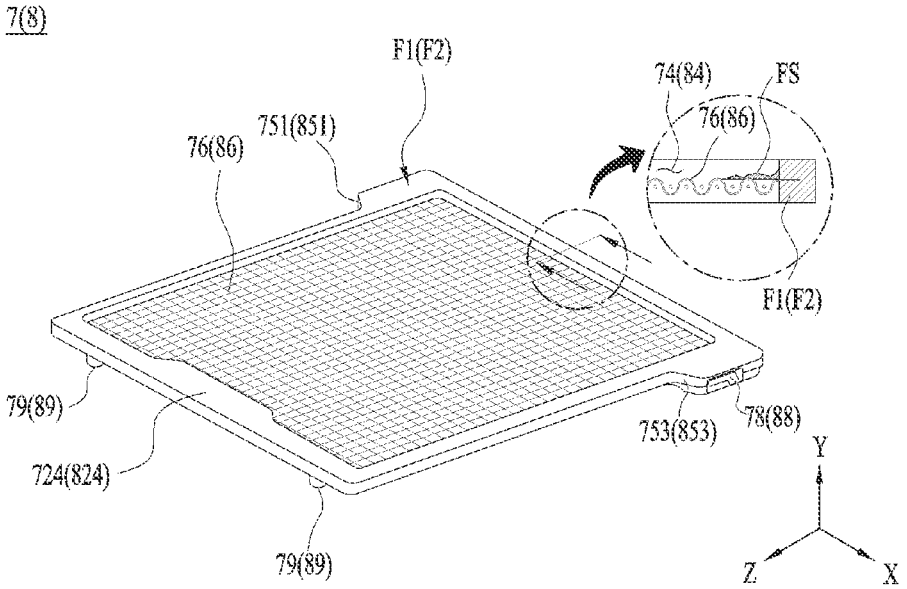
FIG. 5 shows a first embodiment of a rack provided in the present invention.

The first rack 7 shown in FIG. 5 includes a first rack frame F1 having frame through holes 74, and a first vent portion (first mesh) 76 having fixed to the first rack frame F1 through an edge thereof and positioned in the frame through holes 74.

A side surface of the first rack frame F1 facing the first side surface 215 of the drying chamber 211 (a side surface facing in the X-axis direction) is provided with a first shaft fastening portion (not shown) to which the first first-rack shaft 217 is detachably coupled, and the other side surface of the first rack frame F1 facing the second side surface 216 of the drying chamber 211 (a side surface facing in the X-axis direction) is provided with a second shaft fastening portion 78 to which the second first-rack shaft (not shown) is detachably coupled.

The first shaft fastening portion and the second shaft fastening portion 78 may be provided with a slit with an open lower end (a surface facing the bottom surface 212 of the drying chamber 211). Thereby, the first rack 7 is rotatable toward the introduction port 211*a* and is separable from the drying chamber 211. Accordingly, the user can remove the first rack 7 from the drying chamber 211 when a bulky object needs to be dried.

Both side surfaces of the first rack frame F1 may be further provided with bent portions 751 and 753. The bent portion 751 may include a first bent portion 751 provided on a side surface of the first rack frame F1 facing the first side surface 215 of the drying chamber 211, and a second bent portion 753 provided on the opposite side surface of the first rack frame F1 facing the second side surface 216 of the drying chamber 211.

The bent portions 751 and 753 are formed by concavely bending both side surfaces of the first rack frame F1 away from both side surfaces 215, 216 (the first side and the second side) of the drying chamber 211 such that the space located above the first rack 7 communicates with the space located below the first rack 7. Since the bent portions 751 and 753 allow a part of clothes placed on the first rack 7 to be spread into the space below the first rack 7, they are useful for drying long clothes. Unlike the case of FIG. 5, only one of the first bent portion 751 and the second bent portion 753 may be provided.

A handle 724 may be further provided on the upper surface of the first rack frame F1, and an insulating portion 79 may be further provided on the lower surface of the first rack frame F1. The insulating portion 79 may be formed of an elastic material such as rubber. The insulator 79 absorbs an impact on the first rack frame F1 when the first rack frame F1 contacts the first support 251 provided on the front surface 213 of the drying chamber 211, and accordingly may prevent breakage of the first rack frame F1 and noise.

The second rack 8 may have the same structure as the first rack 7 described above. That is, the second rack 8 may include a second rack frame F2, and frame through holes (second rack frame through holes) 84 formed in the second rack frame, the second vent portion (second mesh) 86 being positioned in the frame through holes. A handle (second rack handle) 824 and an insulator (second rack insulator) 89 may be provided on the upper and lower surfaces of the second rack frame F2, respectively. Further, both side surfaces of the second rack frame F2 may be provided with a first second-rack bent portion 851, a second second-rack bent portion 853, a first second-rack shaft fastening portion, and a second second-rack shaft fastening portion 88.

The first rack frame F1 may be coupled with the first mesh 76 through insert injection molding by injecting a thermoplastic resin along the edge of the first mesh 76, and the second rack frame F2 may be coupled with the second mesh 86 through insert injection molding by injecting a thermoplastic resin along the edge of the second mesh 86. In this case, the thermoplastic resin may form a film (film of resin (FR) (aka flash)) blocking the mesh holes located at the edges of the meshes 76 and 86. The film FR formed along the edges of the meshes 76 and 86 may make it difficult to supply air to the clothes placed on the meshes 76 and 86, and cause the user to suspect the failure of the rack.

The first rack 7 and the second rack 8 shown in FIGS. 6 to 9 are capable of preventing the film FR from being formed on the meshes or preventing the film FR formed on the meshes from being exposed to the outside.

Figure 6:
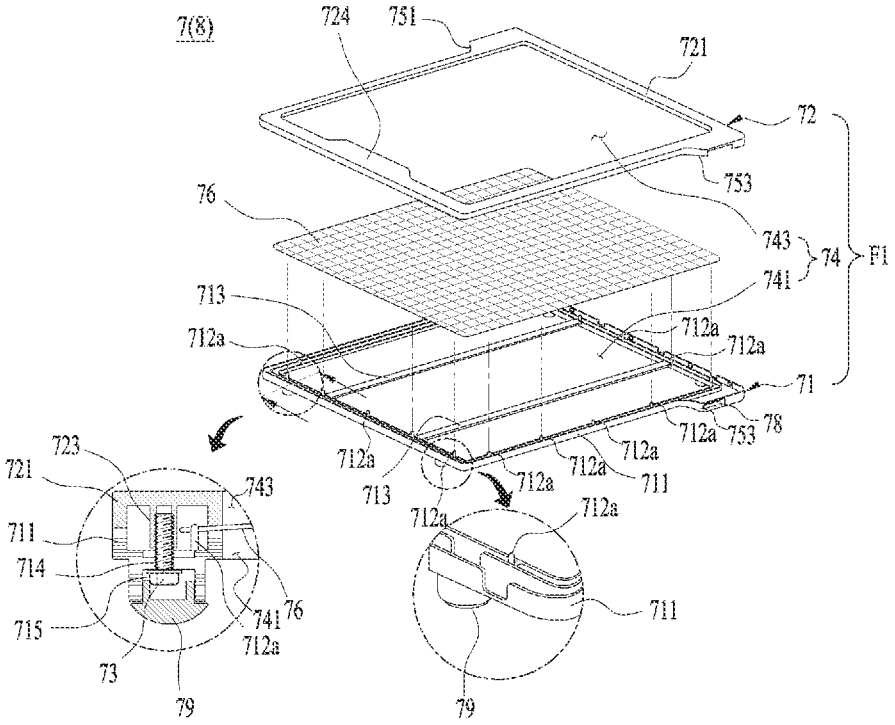
FIG. 6 shows a second embodiment of the rack provided in the present invention.

The first rack 7 and the second rack 8 shown in FIG. 6 are capable of preventing formation of a film FR on the mesh. The first rack 7 and the second rack 8 according to the present embodiment have the same structure. Accordingly, only the structure of the first rack 7 will be described below.

The first rack 7 according to the present embodiment includes a first rack frame F1, a frame through hole 74 formed to penetrate the first rack frame F1, and a first vent portion (first mesh) 76 provided in the frame through hole 74.

The first rack frame F1 is formed by joining a lower first-rack frame 71 and an upper first-rack frame 72. The lower first-rack frame 71 may include a frame body 711 forming the lower surface of the first rack 7, and the upper first-rack frame 72 may include a second frame body 721 coupled to the first frame body 711 to form the upper surface of the first rack 7.

In this case, the frame through hole 74 may include a first body through hole 741 formed through the first frame body 711, and a second body through hole 743 formed through the second frame body 721. When the first frame body 711 and the second frame body 721 are coupled to each other, the first body through hole 741 and the second body through hole 743 form one frame through hole 74.

The first frame body 711 is provided with a plurality of fixing pins 712*a*. The fixing pins 712*a* protrude from the first frame body 711 toward the second frame body 721. Multiple fixing pins 712*a* are positioned along the edge of the first body through hole 741 and the first mesh 76 is fixed to the first frame body 711 through the fixing pins 712*a*. That is, when the holes located at the edge of the first mesh 76 among the multiple mesh holes provided in the first mesh 76 are coupled to the fixing pins 712*a*, the first mesh 76 may be fixed to the first frame body 711. The second frame body 721 is formed in a shape that prevents the fixing pins 712*a* from being exposed to the outside.

In order to prevent the first mesh 76 from sagging, the first frame body 711 may further include a plurality of mesh supports 713 positioned across the first body through hole 741. The second frame body 721 may be provided with a handle 724.

Both side surfaces of the first frame body 711 are provided with a first shaft fastening portion (not shown) to which the first first-rack shaft 217 is detachably coupled, and a second shaft fastening portion 78 to which the second first-rack shaft is detachably coupled. Since the shape and function of the first shaft fastening portion and the second shaft fastening portion 78 have been described above, a detailed description thereof will be omitted. Unlike the configuration shown in FIG. 6, the first shaft fastening portion and the second shaft fastening portion 78 may be provided on both side surfaces of the second frame body 721, respectively.

The first rack 7 provided in the present embodiment may further include a first bent portion 751 provided on a side surface of the first rack frame F1 facing the first side surface 215 of the drying chamber 211, and a second bent portion 753 provided on the opposite side surface of the first rack frame F1 facing the second side surface 216 of the drying chamber 211. Since the function and shape of the first bent portion 715 and the second bent portion 753 have been described above, a detailed description thereof will be omitted. In the case where the first rack frame F1 is formed by coupling between the lower first-rack frame 71 and the upper first-rack frame 72, the first bent portion 751 should be formed on the left side surface of the first frame body 711 and the left side surface of the second frame body 721, respectively, and the second bent portion 753 should be formed on the right side surface of the first frame body 711 and the right side surface of the second frame body 721, respectively.

The first frame body 711 is provided with an insulator 79. The insulator 79 is formed of an elastic material such as rubber to absorb an impact generated when the first rack 7 is seated on the first support 251. The first frame body 711 may be provided with an insulator insertion groove 715 to provide a space in which the insulator 79 is accommodated. The insulator insertion groove 715 may be formed by concavely bending the surface of the first frame body 711 facing the bottom surface 212 of the drying chamber 211 in a direction away from the bottom surface 212.

The first frame body 711 and the second frame body 721 may be coupled to each other through a fastening portion 73 such as a bolt. To this end, the first frame body 711 may include a fastening hole 714, and the second frame body 721 may include a fastening groove 723 provided at a position corresponding to the fastening hole 714. In this case, the fastening portion 73 may be fixed to the fastening groove 723 through the fastening hole 714, thereby joining the two frame bodies 711 and 721.

The fastening hole 714 may be located inside the insulator insertion groove 715. In this case, the insulator 79 may prevent the fastening portion 73 from being exposed to the outside of the first rack 7, thereby preventing corrosion of the fastening portion 73 and enhancing esthetics of the first rack 7.

In the first rack 7 according to the present embodiment, the first mesh 76 is not joined to the first rack frame F1 through insert injection molding, but is fixed to the first rack frame F1 through the fixing pins 712*a* provided to the first frame body 711. Accordingly, a film of a thermoplastic resin may be prevented from being formed on the first mesh 76.

Figure 7:
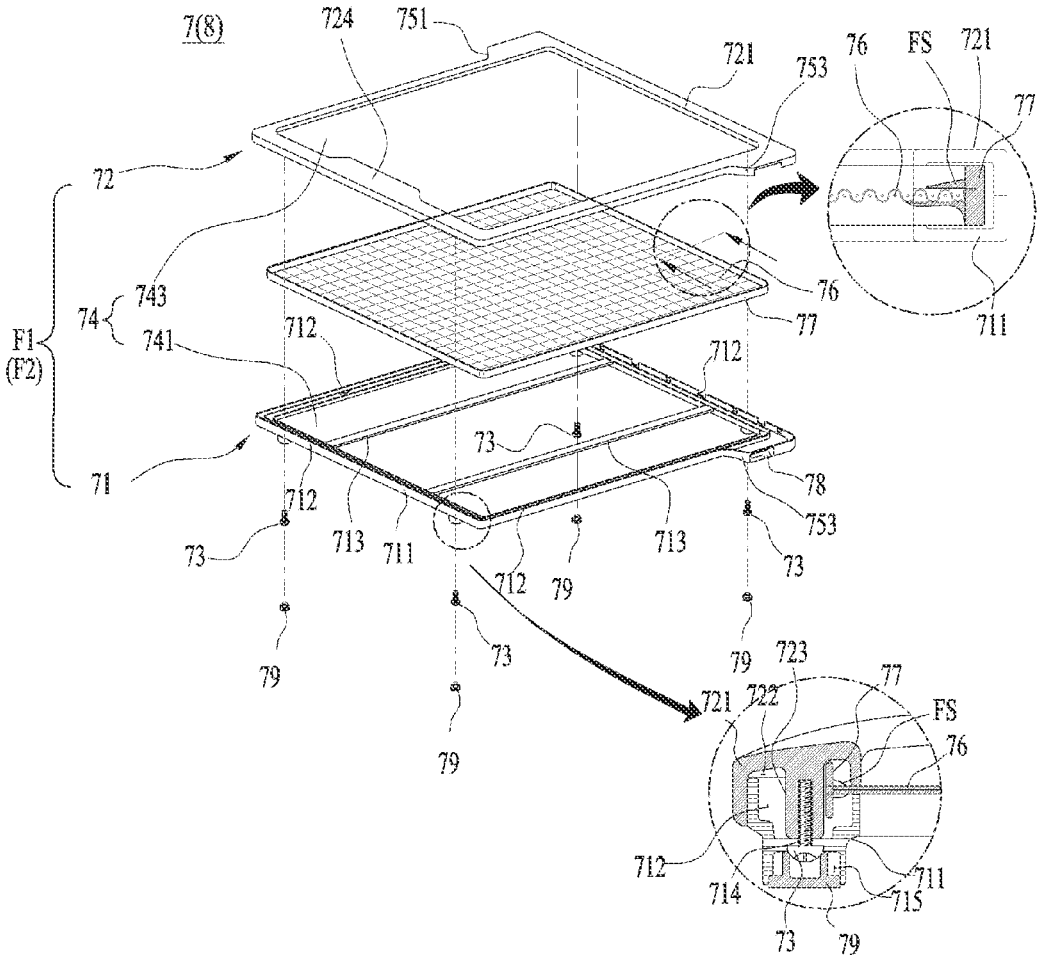
FIG. 7 shows a third embodiment of the rack provided in the present invention.
Figure 8:
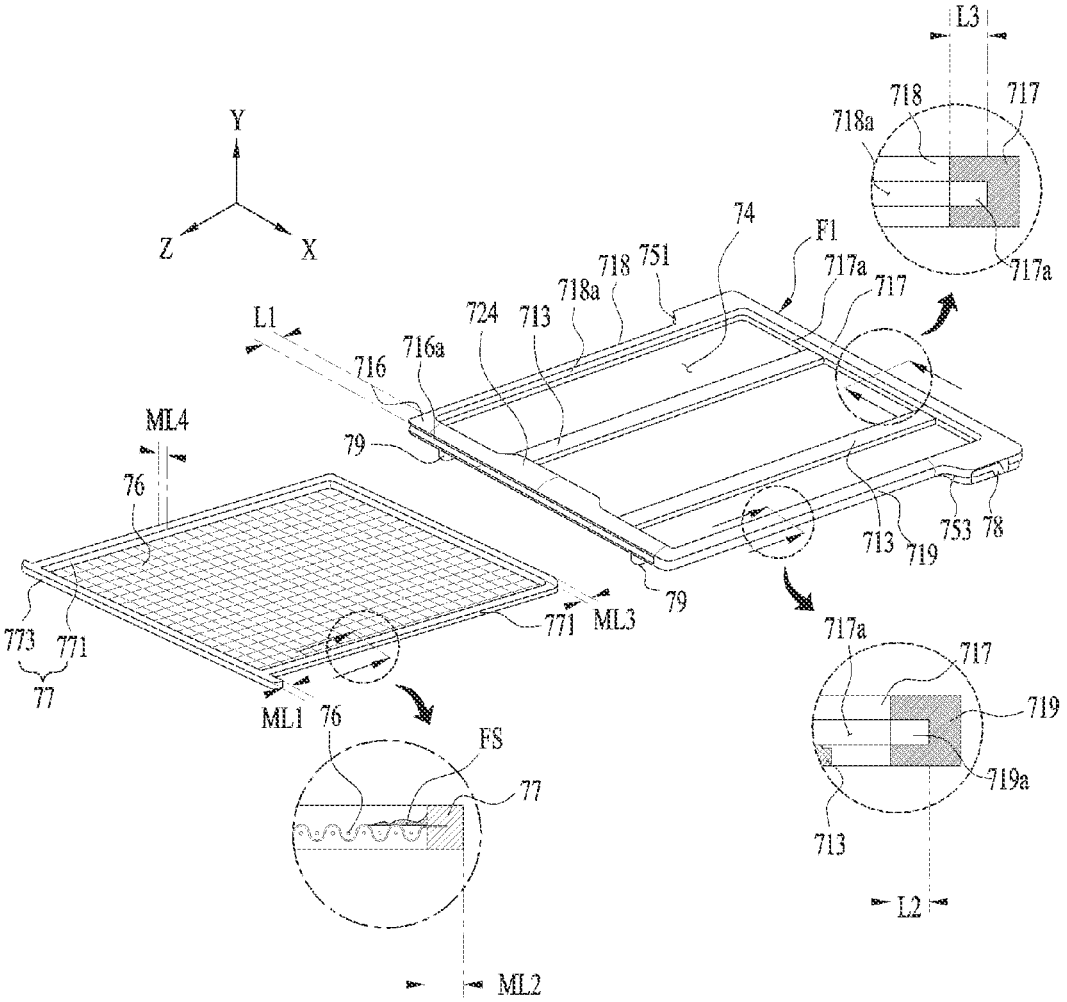
FIGS. 8 and 9 show a fourth embodiment of the rack provided in the present invention.
Figure 9:
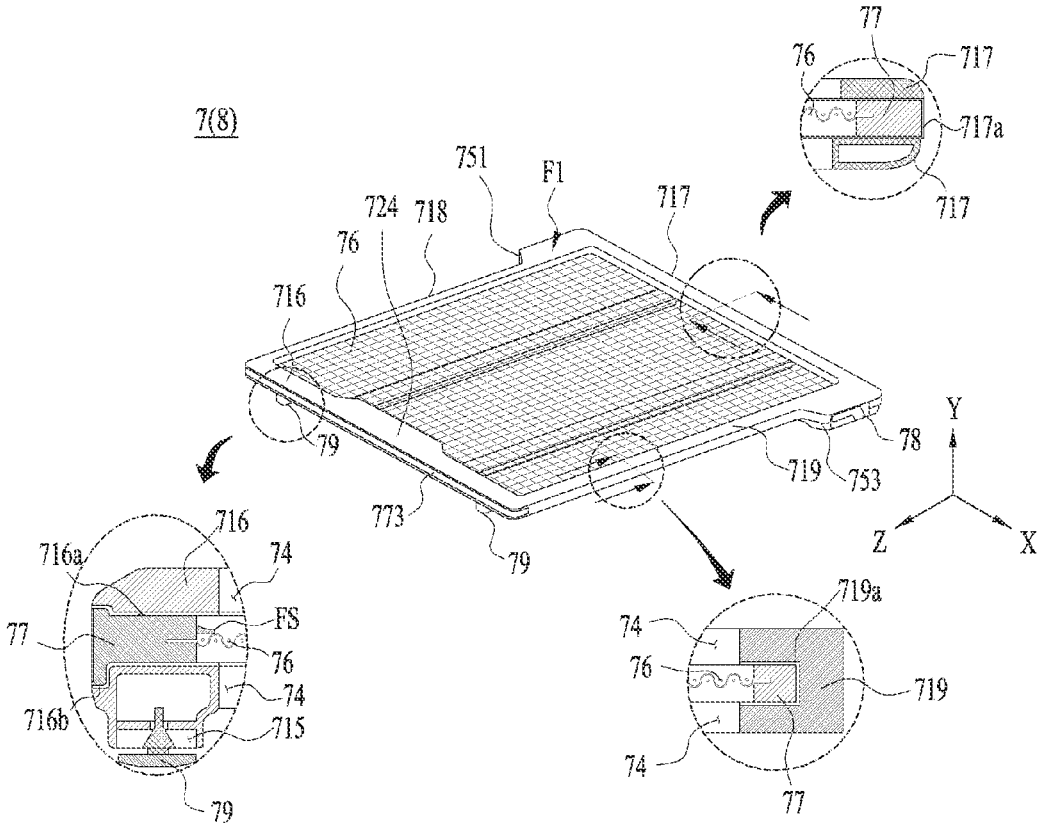

The first rack 7 and the second rack 8 shown in FIGS. 7 to 9 are capable of preventing a film FR formed on the meshes 76 and 86 from being exposed to the outside. In this embodiment, the first rack 7 and the second rack 8 have the same structure. Accordingly, only the structure of the first rack 7 will be described below.

The first rack 7 shown in FIG. 7 includes a first rack frame F1, a frame through hole 74 formed to penetrate the first rack frame F1, a first vent portion (first mesh) 76 providing a space for supporting clothes and allowing a space located above the first rack 7 to communicate with a space located below the first rack 7, and a mesh frame 77 to which an edge of the first mesh 76 is fixed. The first rack frame F1 not only provides a space for coupling the mesh frame 77 but also prevents the joint between the first mesh 76 and the mesh frame 77 from being exposed to the outside. When the mesh frame 77 is coupled to the first rack frame F1, the first mesh 76 is positioned in the frame through hole 74.

The mesh frame 77 is coupled to the first mesh 76 through insert injection molding that supplies a thermoplastic resin along the edge of the first mesh 76. In this case, a film FR formed by a thermoplastic resin filling the holes of the first mesh 76 may be formed at the joint between the first mesh 76 and the mesh frame 77.

The first rack frame F1 is formed by joining a lower first-rack frame 71 and an upper first-rack frame 72. The lower first-rack frame 71 may include a first frame body 711 forming the lower surface of the first rack 7, and the upper first-rack frame 72 may include a second frame body 721 coupled to the first frame body 711 to form the upper surface of the first rack 7. The upper first-rack frame 72 is coupled to the first frame body 711. The first frame body 711 is provided with a first body through hole 741 and the second frame body 721 is provided with a second body through hole 743. The frame through hole 74 is formed by coupling between the first body through hole 741 and the second body through hole 743.

At least one of the first frame body 711 and the second frame body 721 is provided with an accommodation portion 712, 722 for providing a space for accommodating the mesh frame 77. FIG. 7 illustrates an exemplary case where the accommodation portion includes a first accommodation portion 712 provided in the first frame body 711 to accommodate the lower surface of the mesh frame 77, and a second accommodation portion 722 provided in the second frame body 721 to accommodate the upper surface of the mesh frame 77.

As in the embodiment of FIG. 6, the first frame body 711 is provided with an insulator insertion groove 715 in which the insulator 79 is accommodated. The insulator insertion groove 715 may be formed by concavely bending the surface of the first frame body 711 facing the bottom surface 212 of the drying chamber 211 in a direction away from the bottom surface 212.

The first rack 7 further includes a first fastening hole 714 formed to penetrate the first frame body 711 and located in the insulator insertion groove 715, a fastening groove 723 protruding from the second frame body 721 toward the first fastening hole 714, and a fastening portion 73 coupled to the fastening groove 723 through the first fastening hole 714 to couple the first frame body 711 with the second frame body 721.

The mesh frame 77 is accommodated in a space defined by the first accommodation portion 712 and the second accommodation portion 722, and the first mesh 76 is positioned in the frame through hole 74 through a gap formed between the coupling surfaces of the first frame body 711 and the second frame body 721. Accordingly, the first rack 7 according to the present embodiment may prevent or minimize exposure of the film FR formed at the joint between the first rack frame F1 and the first mesh 76 to the outside of the first rack frame F1.

In order to prevent the first mesh 76 from sagging, the first frame body 711 may further include a plurality of mesh supports 713 positioned across the first body through hole 741. A handle 724 may be provided on the upper surface of the second frame body 721.

Both side surfaces of the first frame body 711 are provided with a first shaft fastening portion (not shown) to which the first first-rack shaft 217 is detachably coupled, and a second shaft fastening portion 78 to which the second first-rack shaft is detachably coupled.

The first rack 7 provided in the present embodiment may further include a first bent portion 751 provided on a side surface of the first rack frame F1 facing the first side surface 215 of the drying chamber 211, and a second bent portion 753 provided on the opposite side surface of the first rack frame F1 facing the second side surface 216 of the drying chamber 211. The first bent portion 751 should be formed on the left side surface of the first frame body 711 and the left side surface of the second frame body 721, respectively, and the second bent portion 753 should be formed on the right side surface of the first frame body 711 and the right side surface of the second frame body 721, respectively.

The first rack 7 and the second rack 8 shown in FIGS. 8 and 9 are positioned such that the mesh frame 77 can be drawn out from the rack frames F1 and F2, thereby minimizing exposure of the film FR formed along the edges of the meshes 76 and 86 to the outside. Since the first rack 7 and the second rack 8 according to the present embodiment may have the same structure, only the first rack 7 will be described below.

As shown in FIG. 8, the first rack 7 according to the present embodiment includes a first rack frame F1, a frame through hole 74 formed to penetrate the first rack frame F1, a first vent portion (first mesh) 76 providing a space for supporting clothes and allowing a space located above the first rack 7 to communicate with a space located below the first rack 7, and a mesh frame 77 to which an edge of the first mesh 76 is fixed.

The mesh frame 77 includes a mesh frame body 771 to which the edge of the first mesh 76 is fixed, and a mesh frame stopper 773 provided on the front surface of the mesh frame body 771. The mesh frame body 771 may be coupled to the first mesh 76 through insert injection molding by supplying a thermoplastic resin to the edge of the first mesh 76. In this case, a film FR may be formed at a joint between the first mesh 76 and the mesh frame body 771. The mesh frame stopper 773 may serve as a handle of the mesh frame 77.

The first rack frame F1 may include a front frame 716 forming a front surface of the first rack 7, a rear frame 717 forming a rear surface of the first rack 7, and a first side frame 718 and a second side frame 719 positioned to connect the front frame 716 and the rear frame 717 to each other.

The front frame 716, the rear frame 717, the first side frame 718, and the second side frame 719 may be positioned around the frame through hole 74 such that the frame through hole 74 is formed at the center.

The front frame 716 may include a slit or slot 716*a* formed to penetrate the front frame 716 to communicate with the frame through hole 74, and a seating groove 716*b* (see FIG. 9) formed by concavely bending the front surface of the front frame 716, the mesh frame stopper 773 being seated on the seating groove.

At least one of the rear frame 717, the first side frame 718, and the second side frame 719 is further provided with a frame guide for supporting the mesh frame body 771. The frame guide may include at least one of a first side guide 718*a* provided to the first side frame 718, a second side guide 719*a* provided to the second side frame 719, and a rear guide 717*a* provided to the rear frame 717.

The first side guide 718*a* may be formed as a groove by concavely bending the surface of the first side frame 718 in a direction away from the second side frame 719, and the second side guide 719*a* may be formed as a groove by concavely bending the surface of the second side frame 719 in a direction away from the first side frame 718.

The first side guide 718*a* and the second side guide 719*a* extend from both ends of the slit or slot 716*a* toward the rear frame 717. The first side guide 718*a* provides a space for accommodating one side surface of the mesh frame body 771 and the second side guide 719*a* provides a space for accommodating the opposite side surface of the mesh frame body 771.

The length L1 of the front frame with respect to the direction (the Z-axis direction) in which the mesh frame 77 is inserted may be set to be greater than the length ML1 of the mesh frame 77 in the direction (the Z-axis direction) in which the mesh frame 77 is inserted.

The depth of the first side guide 718*a* facing in a direction (the X-axis direction) away from the second side frame 719 may be set to be greater than the width ML4 of the side surface of the mesh frame body 771 (the width of the first surface of the mesh frame), and the depth L2 of the second side guide 719*a* facing in a direction (the X-axis direction) away from the first side frame 718 may be set to be greater than the width ML2 of the side surface of the mesh frame body 771 (the width of the second side surface of the mesh frame). This is intended to minimize exposure of the film FR formed on the first mesh 76 to the outside.

The rear guide 717*a* is a means for providing a space for inserting the rear surface of the mesh frame body 771. The rear guide 717*a* may be provided as a groove formed by concavely bending the surface of the rear frame 717 in a direction (the Z-axis direction) away from the front frame 716, or may be provided as a rear frame through hole (see FIG. 9) formed to penetrate the rear frame 717.

In any case, the length L3 of the rear guide 717*a* with respect to the direction in which the mesh frame 77 is inserted should be set to be greater than the length ML3 of the rear surface of the mesh frame body 771 with respect to the direction in which the mesh frame 77 is inserted.

In order to prevent the first mesh 76 from sagging, the first rack frame F1 may be provided with a plurality of mesh supports 713 connecting the front frame 716 and the rear frame 717.

As shown in FIG. 9, an insulator insertion groove 715 to which an insulator 79 is fixed may be formed on the lower surface of the front frame 716, and a handle 724 is formed on the upper surface of the front frame 716.

The first side frame 718 and the second side frame 719 are provided with a first shaft fastening portion (not shown) to which the first first-rack shaft 217 is detachably coupled, and a second shaft fastening portion 78 to which the second first-rack shaft is detachably coupled, respectively. The first side frame 718 is provided with a first bent portion 751 bent in a direction (X-axis direction) away from the first side surface 215 of the drying chamber 211, and the second side frame 719 is provided with a second bent portion 753 bent in a direction (X-axis direction) away from the second side surface 216 of the drying chamber 211. Since the shapes and functions of the first shaft fastening portion, the second shaft fastening portion 78, the first bent portion 751, and the second bent portion 753 have been described above, a detailed description thereof will be omitted.

Figure 10:
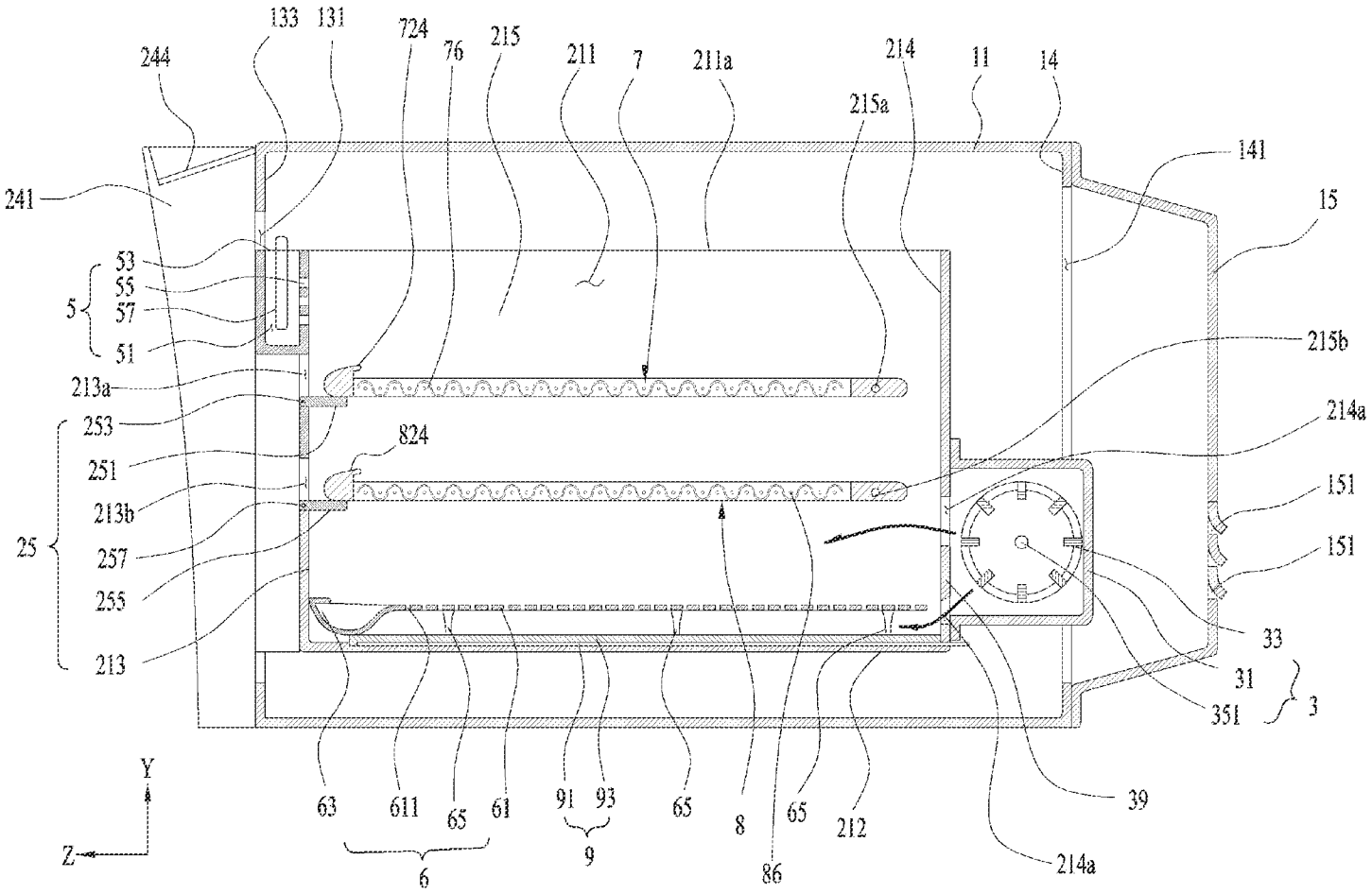
FIG. 10 shows another embodiment of the laundry treatment apparatus of the present invention.
Figure 11:
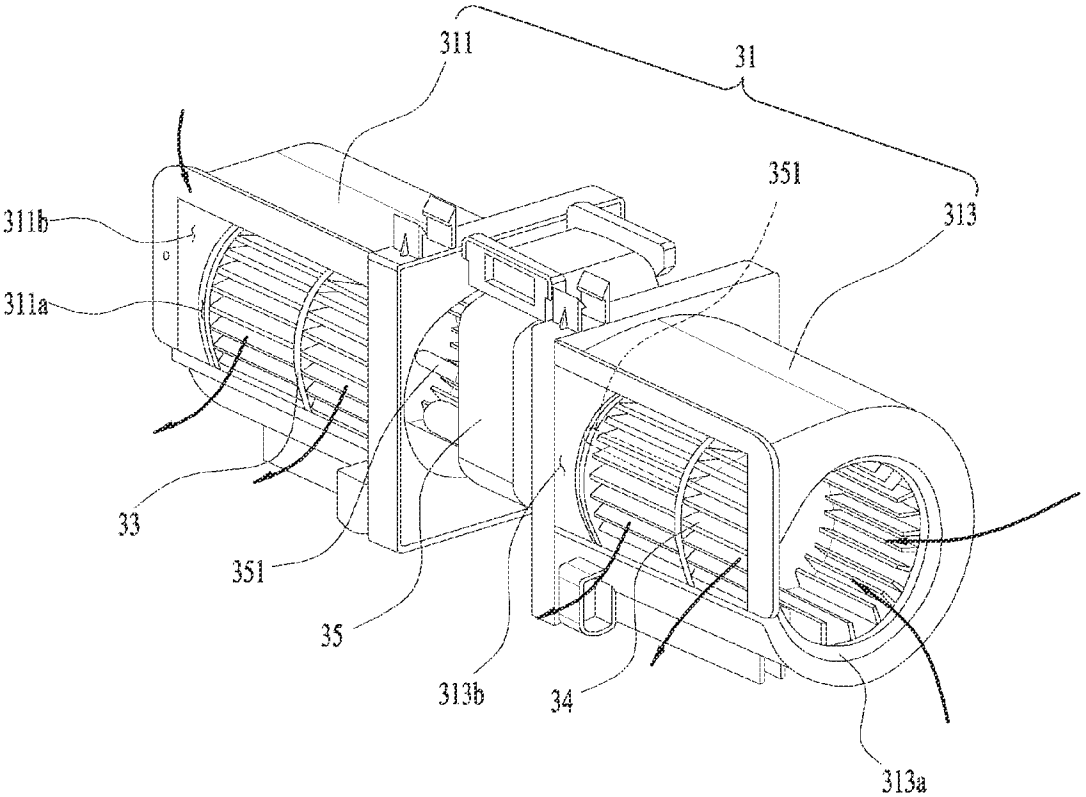
FIG. 11 shows another embodiment of the air supply unit.
Figure 12:
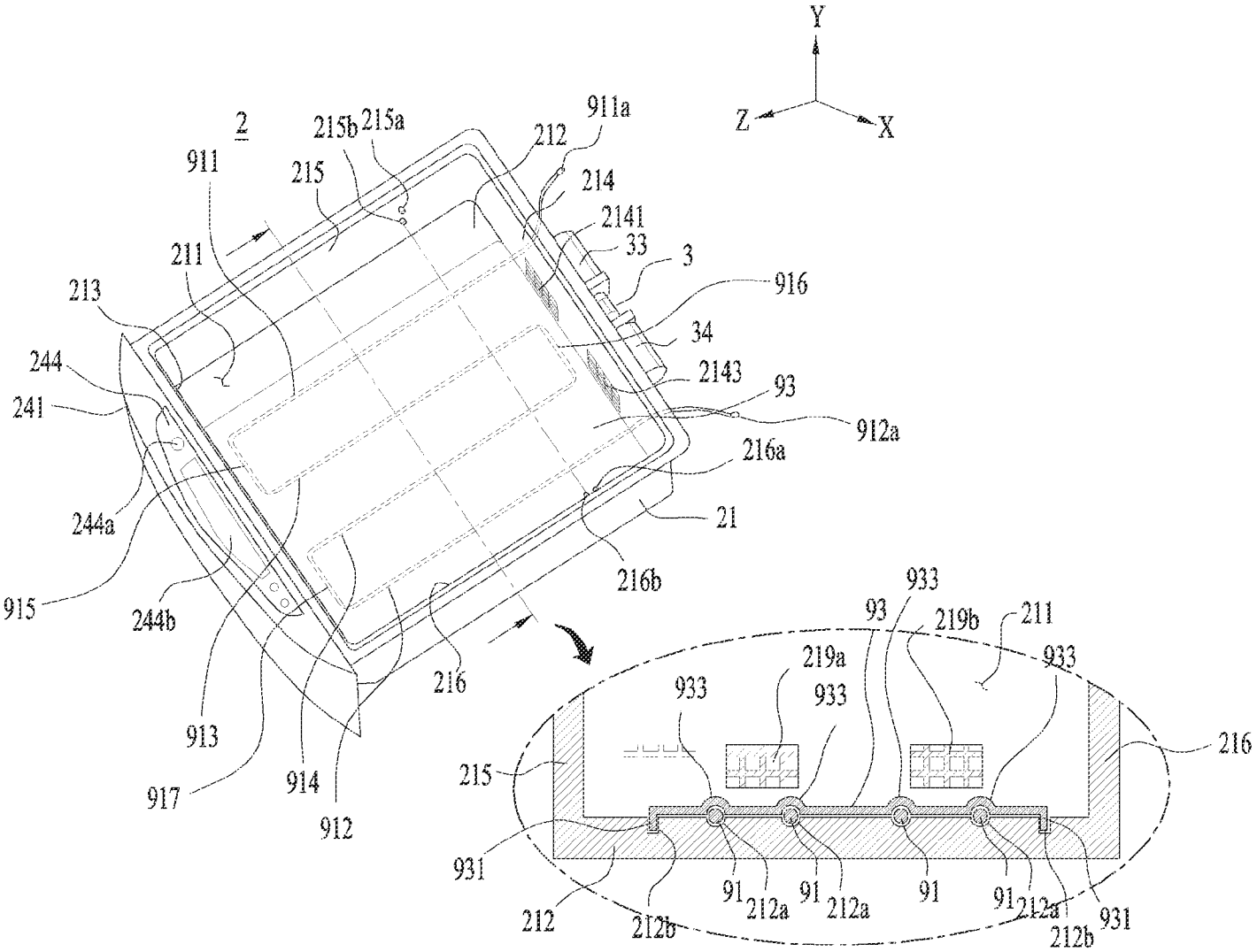
FIG. 12 shows an example of a heating unit provided in the present invention.

FIGS. 10 to 12 show another embodiment of the laundry treatment apparatus of the present invention. As shown in FIG. 10, the laundry treatment apparatus 100 according to this embodiment includes a cabinet 1, a drawer 2 positioned in the cabinet 1 so as to be drawn out, a drying chamber 211 positioned in the drawer 2 to provide a drying space, at least one rack 7, 8 positioned inside the drying chamber 211 to provide a space for supporting clothes, and an air supply unit 3 configured to supply heated air (hot air) or non-heated air to the drying chamber 211. The structure of the cabinet 1 and the drawer 2 is the same as that of the cabinet and drawer provided in the laundry treatment apparatus shown in FIGS. 1 to 3, and a detailed description thereof will be omitted.

As shown in FIG. 10, the rack may include a first rack (upper rack) 7 located inside the drying chamber 211, and a second rack (lower rack) 8 located between the first rack 7 and the bottom surface 212. The structure of the racks 7 and 8 is the same as that of the racks shown in FIGS. 1 to 9, and a detailed description thereof will be omitted.

The first rack 7 and the second rack 8 may be positioned so as to be rotated toward the introduction port 211*a* with respect to shafts provided on the first side surface 215 and the second side surface 216 (see FIG. 1) of the drying chamber 211. That is, the first rack 7 may be rotated toward the introduction port 211*a* by a first first-rack shaft 215*a* provided on the first side surface 215 and a second first-rack shaft 216*a* (see FIG. 12) provided on the second side surface 216, and the second rack 8 may be rotated toward the introduction port 211*a* in the drying chamber 211 by a first second-rack shaft 215*b* (positioned under the first first-rack shaft 215*a*) provided on the first side surface 215 and a second second-rack shaft 216*b* (see FIG. 12) provided on the second side surface 216.

The air supply unit 3 supplies hot air to the drying chamber 211 through supply ports 214*a* formed through the surface of the drying chamber 211 in a penetrating manner. In FIG. 10, the supply ports 214*a* are illustrated as being holes formed by penetrating the rear surface 214.

As shown in FIG. 11, the air supply unit 3 may include a housing 31 communicating with the drying chamber 211 through the supply port 214*a*, a first impeller 33 and a second impeller 34 positioned in the housing, and a motor 35 having a rotary shaft 351 configured to rotate the impellers 33, 34. The housing 31 may include a first housing 311 for providing a space for accommodating the first impeller 33 and a second housing 313 for providing a space for accommodating the second impeller 34.

The first impeller 33 and the second impeller 34 may be provided as centrifugal impellers configured to suction air through a rotation center and discharge air through a circumferential surface. The first housing 311 and the second housing 313 may be cylindrically formed to accommodate the respective impellers 33, 34.

The first housing 311 may include a first inlet 311*a* provided on one surface thereof parallel to the first side surface 215 of the drying chamber 211 and a first outlet 311*b* provided on a circumferential surface thereof facing the rear surface 214 of the drying chamber 211 to communicate with the supply port 214*a*. The second housing 313 may include a second inlet 313*a* provided on one surface thereof parallel to the second side surface 216 of the drying chamber 211 and a second outlet 313*b* provided on a circumferential surface thereof facing the rear surface 214 of the drying chamber 211 to communicate with the supply port 214*a*. The motor 35 may be a double-shaft motor configured to rotate two impellers 33 and 34 through a single rotary shaft 351.

As shown in FIG. 10, a heating unit 9 configured to heat air supplied through the supply port 214*a* is positioned on the bottom surface 212 of the drying chamber 211. The heating unit 9 may include a heating plate 93 made of a connector and forming at least a part of the bottom surface 212, and a heating element 91 disposed between the bottom surface 212 and the heating plate 93 to generate heat when current is supplied thereto.

The heating plate 93 may cover the entire bottom surface 212 or may cover a part of the bottom surface 212. FIG. 12 illustrates an example in which the heating plate 93 is positioned to form a part of the bottom surface 212. Since the heating plate 93 is a means for heating air supplied from the air supply unit 3, a wider area of the heating plate 93 is more advantageous for heating. Accordingly, the area of the heating plate 93 may be set to be 80% or more of the area of the bottom surface 212.

The shape of the heating plate 93 may correspond to the shape of the bottom surface 212. In the example of FIG. 12, the heating plate 93 is illustrated as having a rectangular shape. A bent portion 931 that is bent toward the bottom surface 212 may be provided at an edge of the heating plate 93, and a bent portion accommodation groove 212*b* into which the bent portion 931 is inserted may be formed in the bottom surface 212.

The heating plate 93 may further include an accommodation groove 933 protruding in a direction away from the bottom surface 212 to provide a space for accommodating the heating element 91. The accommodation groove 933 is not only a means for providing a space for accommodating the heating element 91 but also a means for shortening the heating time by widening the contact area between the air supplied by the air supply unit 3 and the heating plate 93.

The surface area of the heating plate 93 may be set to be larger than the area of the bottom surface 212 by adjusting the surface area and number of the accommodation grooves 933 in order to shorten the time for heating air.

The supply port 214*a* formed to penetrate the rear surface 214 of the drying chamber 211 may include a first supply port 2141 communicating with the first outlet 311*b*, and a second supply port 2143 communicating with the second outlet 313*b*.

The first supply port 2141 and the second supply port 2143 are disposed in a space between the second rack 8 and the heating element 91. Further, the first supply port 2141 and the second supply port 2143 may be further provided with a guide 39 (see FIG. 10) for guiding air to a space between the second rack 8 and the spacer 6 and a space between the spacer 6 and the bottom surface 212.

As shown in FIG. 12, the heating element 91 may include a first heating element 911 and a second heating element 912 extending from the rear surface 214 of the drying chamber 211 toward the front surface 213 and spaced apart from each other along in a width direction (X-axis direction) of the drying chamber, a third heating element 913 positioned between the first heating element 911 and the second heating element 912 and extending from the front surface 213 of the drying chamber 211 toward the rear surface 214, and a fourth heating element 914 positioned between the third heating element 913 and the second heating element 912 and extending from the front surface 213 toward the rear surface 214. The first heating element 911 and the second heating element 912 may include a first terminal 911*a* and a second terminal 912*a*, respectively, the first terminal 911*a* and second terminal 912*a* being exposed to the outside of the drying chamber 211 through the rear surface 214 of the drying chamber 211.

The first heating element 911 and the third heating element 913 may be connected by a first connection heating element 915 extending from the first side surface 215 of the drying chamber 211 toward the second side surface 216. The third heating element 913 and the fourth heating element 914 may be connected by a second connection heating element 916 extending from the first side surface 215 of the drying chamber 211 toward the second side surface 216. The fourth heating element 914 and the second heating element 912 may be connected by a third connection heating element 917 extending from the first side surface 215 of the drying chamber 211 toward the second side surface 216.

The bottom surface 212 of the drying chamber 211 may further include a heating element accommodation groove 212*a* for accommodating a part of the circumferential surface of the heating element 91 to facilitate arrangement of the heating element 91.

In order to shorten the time required for the air supplied through the supply ports 2141 and 2143 and hole portions 219*a*, 219*b* to be heated by the heating plate 93, the first supply port 2141 may be positioned to supply air to a space formed between the first heating element 911 and the third heating element 913, and the second supply port 2143 may be positioned to supply air to a space formed between the fourth heating element 914 and the second heating element 912.

As apparent from the above description, the present invention has the following configurations or embodiments.

For example, the present invention may provide a laundry treatment apparatus capable of drying a large amount of clothes at one time by providing multiple racks in a drying chamber and supplying air evenly to the respective racks.

In addition, the present invention may provide a laundry treatment apparatus with a rack capable of preventing or minimizing exposure of a film of a thermoplastic resin formed on a mesh of the rack to the outside.

It will be apparent to those skilled in the art that various modifications and variations can be made in the present invention without departing from the spirit and scope of the invention. Thus, it is intended that the present invention covers the modifications and variations of this invention, provided they come within the scope of the appended claims and their equivalents.

What is claimed is:

1. A laundry treatment apparatus comprising:

a cabinet having an entrance;

a drawer arranged so as to be drawn out from the cabinet through the entrance and provided with a drying chamber, the drying chamber including a bottom surface, a front surface extending upward from the bottom surface, a rear surface fixed to the bottom surface and arranged at a position facing the front surface, and first and second side surfaces fixed to the bottom surface to connect the front surface and the rear surface;

a supply port formed to penetrate the rear surface;

an air supply unit fixed to the rear surface and located outside the drying chamber to supply air into the drying chamber through the supply port;

a heating plate formed of a conductor and forming at least a part of the bottom surface; and a heating element located between the bottom surface and the heating plate and configured to generate heat when electric current is supplied thereto.

2. The laundry treatment apparatus of claim 1, wherein an area of the heating plate may be set to 80% or more of an area of the bottom surface.

3. The laundry treatment apparatus of claim 2, wherein the heating plate comprises an accommodation groove protruding in a direction away from the bottom surface to provide a space for accommodating the heating element.

4. The laundry treatment apparatus of claim 3, further comprising:

a rack arranged in the drying chamber; and a mesh arranged on the rack to provide a space for supporting the clothes and having a plurality of holes allowing a space above the rack to communicate with a space below the rack, wherein the supply port may be located between the rack and the bottom surface.

5. The laundry treatment apparatus of claim 4, wherein the rack comprises a first rack arranged in the drying chamber to provide a space for supporting clothes; and a second rack provided in the drying chamber to provide a space for supporting clothes, and positioned between the first rack and the heating plate, and the supply port is located between the second rack and the heating plate.

6. The laundry treatment apparatus of claim 5, further comprising:

a support body positioned between the rack and the bottom surface to provide a space for supporting the clothes;

a plurality of protrusions protruding from the support body toward the heating plate so as to maintain a gap between the support body and the heating plate; and a support body through hole formed to penetrate the support body.

7. The laundry treatment apparatus of claim 6, further comprising a guide for guiding part of air discharged from the supply port to a space between the support body and the heating plate.

8. The laundry treatment apparatus of claim 4, further comprising a mesh frame for fixing an edge of the mesh, wherein the rack comprises:

a rack frame to which the mesh frame is withdrawably fixed;

a frame through hole formed to penetrate the rack frame to provide a space in which the mesh is positioned when the mesh frame is inserted into the rack frame.

9. The laundry treatment apparatus of claim 8, wherein the rack frame comprises:

a front frame forming a front surface;

a rear frame forming a rear surface;

a first side frame and a second side frame connecting the front frame and the rear frame;

a slit formed to penetrate the front frame to allow the frame through hole to communicate with an outside; and a frame guide provided to at least one of the rear frame, the first side frame, and the second side frame to support the mesh frame.

10. The laundry treatment apparatus of claim 9, wherein the length of the front frame with respect to an insertion direction of the mesh frame is set to be greater than the length of the front surface of the mesh frame with respect to the insertion direction of the mesh frame.

11. The laundry treatment apparatus of claim 9, wherein the frame guide comprises:

a first side guide provided with a groove formed by concavely bending a surface of the first side frame in a direction away from the second side frame to provide a space for accommodating a first side surface of the mesh frame; and a second side guide provided with a groove formed by concavely bending a surface of the second side frame in a direction away from the first side frame to provide a space for accommodating a second side surface of the mesh frame.

12. The laundry treatment apparatus of claim 11, wherein a depth of the first side guide facing away from the second side frame is set to be greater than a width of the first side surface of the mesh frame, and a depth of the second side guide facing away from the first side frame is set to be greater than a width of the second side surface of the mesh frame.

13. The laundry treatment apparatus of claim 9, wherein the frame guide comprises a rear guide provided to the rear frame to provide a space into which a rear surface of the mesh frame is inserted.

14. The laundry treatment apparatus of claim 13, wherein the rear guide is formed as a rear frame through hole formed to penetrate the rear frame, or a groove formed by concavely bending a surface of the rear frame in a direction away from the front frame.

15. The laundry treatment apparatus of claim 14, wherein a length of the rear guide with respect to an insertion direction of the mesh frame is set to be greater than a length of the rear surface of the mesh frame with respect to the insertion direction of the mesh frame.

16. The laundry treatment apparatus of claim 3, wherein the heating element comprises:

a first heating element extending from the rear surface toward the front surface;

a second heating element extending from the rear surface toward the front surface and disposed at a position spaced apart from the first heating element;

a third heating element extending from the front surface toward the rear surface, the third heating element being positioned between the first heating element and the second heating element;

a fourth heating element extending from the front surface toward the rear surface, the fourth heating element being positioned between the third heating element and the second heating element;

a first connection heating element for connecting the first heating element and the third heating element;

a second connection heating element for connecting the third heating element and the fourth heating element;

a third connection heating element for connecting the fourth heating element and the second heating element;

a first terminal provided to the first heating element and exposed to an outside of the drying chamber through the rear surface; and a second terminal provided to the second heating element and exposed to the outside of the drying chamber through the rear surface.

17. The laundry treatment apparatus of claim 16, wherein the supply port comprises: a first supply port configured to supply air to a space between the first heating element and the third heating element; and a second supply port configured to supply air to a space between the fourth heating element and the second heating element, and the air supply part comprises a first impeller for discharging air to the first supply port, and a second impeller for discharging air to the second supply port.

* * * * *